US006971338B2

(12) United States Patent
Kobayashi et al.

(10) Patent No.: US 6,971,338 B2
(45) Date of Patent: Dec. 6, 2005

(54) VARIABLE CYCLE ENGINE AND OPERATION MODE SWITCHING METHOD

(75) Inventors: Tatsuo Kobayashi, Susono (JP); Shouji Katsumata, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/786,152

(22) Filed: Feb. 26, 2004

(65) Prior Publication Data

US 2004/0173166 A1 Sep. 9, 2004

(30) Foreign Application Priority Data

Mar. 3, 2003 (JP) ..... 2003-055605

(51) Int. Cl.[7] ..... F02B 69/06
(52) U.S. Cl. ..... 123/21; 123/90.11
(58) Field of Search ..... 123/21, DIG. 7, 123/90.11

(56) References Cited

U.S. PATENT DOCUMENTS

| | | | | |
|---|---|---|---|---|
| 4,037,412 | A * | 7/1977 | Jones | 60/605.1 |
| 4,392,459 | A * | 7/1983 | Chareire | 123/21 |
| 4,765,293 | A | 8/1988 | Gonzalez | |
| 4,945,870 | A * | 8/1990 | Richeson | 123/90.11 |
| 5,191,858 | A * | 3/1993 | McWhorter | 123/21 |
| 5,517,951 | A * | 5/1996 | Paul et al. | 123/21 |
| 6,237,562 | B1 | 5/2001 | Awasaka et al. | |
| 6,615,771 | B2 * | 9/2003 | Denger et al. | 123/21 |
| 6,619,241 | B2 * | 9/2003 | Otterspeer et al. | 123/21 |

FOREIGN PATENT DOCUMENTS

| | | |
|---|---|---|
| DE | 101 00 054 A1 | 7/2002 |
| EP | 1 234 960 A2 | 8/2002 |
| EP | 1 234 961 A2 | 8/2002 |
| FR | 2 669 377 | 5/1992 |
| JP | A 10-103092 | 4/1998 |
| JP | A 11-280504 | 10/1999 |
| JP | A 11-336647 | 12/1999 |
| JP | A 2000-192828 | 7/2000 |
| JP | A 2001-152919 | 6/2001 |

* cited by examiner

*Primary Examiner*—Henry C. Yuen
*Assistant Examiner*—Jason Benton
(74) *Attorney, Agent, or Firm*—Oliff & Berridge, PLC

(57) ABSTRACT

An engine is operated in accordance with a plurality of operation modes obtained by combining one of a 4-cycle mode and a 2-cycle mode with one of a combustion ignition control where an ignition is performed with an ignition unit and a self ignition priority control including the ignition performed without the ignition unit. Upon switching of the operation mode, a transition cycle is performed once between a first operation mode before switching of the operation mode and a second operation mode after switching of the operation mode. Timing for operating an intake valve or an exhaust valve in the transition cycle is different from that in the second operation mode. The combustion ignition control is executed in one of the combustion chambers where the single operation of the transition cycle is completed until a single cycle of each transient cycle in the rest of the combustion chambers is terminated.

15 Claims, 14 Drawing Sheets

(I) 4-CYCLE SPARK IGNITION MODE IN LOW LOAD (IV) 4-CYCLE SPARK IGNITION MODE IN HIGH LOAD (III) 4-CYCLE SELF IGNITION MODE (II) 2-CYCLE SELF IGNITION MODE (T1) 4-CYCLE SPARK IGNITION MODE IN HIGH LOAD → 2-CYCLE SELF IGNITION MODE (T1L) 4-CYCLE SPARK IGNITION MODE IN LOW LOAD → 2-CYCLE SELF IGNITION MODE (T4) 4-CYCLE SELF IGNITION MODE → 2-CYCLE SELF IGNITION MODE (T2) 2-CYCLE SELF IGNITION MODE →
4-CYCLE SPARK IGNITION MODE IN HIGH LOAD
(T2L) 2-CYCLE SELF IGNITION MODE →
4-CYCLE SPARK IGNITION MODE IN LOW LOAD (T5) 4-CYCLE SPARK IGNITION MODE IN HIGH LOAD →
4-CYCLE SELF IGNITION MODE
(T5L) 4-CYCLE SPARK IGNITION MODE IN LOW LOAD →
4-CYCLE SELF IGNITION MODE (T6) 4-CYCLE SELF IGNITION MODE →
4-CYCLE SPARK IGNITION MODE IN HIGH LOAD
(T6L) 4-CYCLE SELF IGNITION MODE →
4-CYCLE SPARK IGNITION MODE IN LOW LOAD

VARIABLE CYCLE ENGINE AND OPERATION MODE SWITCHING METHOD

INCORPORATION BY REFERENCE

The disclosure of Japanese Patent Application No. 2003-055605 filed on Mar. 3, 2003, including the specification, drawings and abstract are incorporated herein by reference in its entirety.

BACKGROUND OF THE INVENTION

1. Field of Invention

The invention relates to a variable cycle engine that is switchable between a 4-cycle mode and a 2-cycle mode, and more particularly to a technology that is capable of switching the operation of the variable cycle engine smoothly between the 4-cycle mode and the 2-cycle mode.

2. Description of Related Art

An internal combustion engine having two operation modes, that is, a spark ignition mode where the fuel is combusted with spark ignition, and a self-ignition mode where the fuel is combusted with compressed self-ignition has been known as being disclosed in JP-A-11-280504 and other publications as listed below;

JP-A-11-336647,
JP-A-2000-192828,
JP-A-2001-152919, and
JP-A-10-103092.

In the internal combustion engine of the aforementioned type, however, there has been a difficulty in a smooth switching of the mode between the spark ignition mode operation and the self-ignition mode operation.

SUMMARY OF THE INVENTION

It is an object of the invention to provide an internal combustion engine having a plurality of operation modes which allows a smooth switching of the operation mode.

In an engine with variable cycle switchable between a 4-cycle mode and a 2-cycle mode, a predetermined process is executed for a smooth switching of the operation mode. The engine is provided with a plurality of combustion chambers each including a cylinder, a piston, an intake valve and an exhaust valve provided in the cylinder, a fuel injection unit for injecting fuel into the cylinder, and an ignition unit for ignition of the fuel within the cylinder, and a control unit that controls an operation of the intake valve, the exhaust valve, the fuel injection unit, and the ignition unit.

The control unit of the engine executes a plurality of operation modes in accordance with a combination of one of the 4-cycle mode and the 2-cycle mode with one of a combustion ignition control and a self ignition priority control. The combustion ignition control performs an ignition with the ignition unit at a predetermined timing before top dead center of the piston, and the self ignition priority control performs one of the ignition without the ignition unit and the ignition with the ignition unit at a timing delayed from the predetermined timing under the combustion ignition control.

Preferably the control unit performs at least one transition cycle upon switching of an operation mode of the engine between a first operation mode and a second operation mode. The first operation mode is performed before the switching, the second operation mode is performed after the switching, and the transition cycle performs an operation of a same cycle type as the second operation mode under the combustion ignition control. It is also preferable that the transition cycle is different from the second operation mode in at least one of an intake valve opening timing, an intake valve closing timing, an exhaust valve opening timing, an exhaust valve closing timing, an injection quantity of the fuel, and an injection timing of the fuel.

Preferably the combustion ignition control is executed in one of the combustion chambers where a single cycle of the transition cycle is terminated until each of all the combustion chambers terminates a single cycle of the transition cycle irrespective of the second operation mode under one of the combustion ignition control and self ignition priority control. According to the embodiment, the transition cycle is performed between operations before and after the mode switching. This makes it possible to switch the operation mode smoothly without causing misfire or torque change.

In the case where the first operation mode is the 2-cycle mode, the second operation mode is the 4-cycle mode under the combustion ignition control, and each of the transition cycle and the second operation mode has an overlap period at which both the intake valve and the exhaust valve are opened, it is preferable to delay the intake valve opening timing in the transition cycle from that in the second operation mode.

In the engine operation in the 2-cycle mode, explosion occurs once at a full rotation of the crankshaft. In the engine operation in the 4-cycle mode, explosion occurs at two full rotations of the crankshaft. The temperature of the cylinder wall in the 2-cycle operation may become higher than that of the cylinder wall in the 4-cycle operation. Accordingly the temperature of the cylinder wall is kept high immediately after switching the operation mode from the 2-cycle mode to the 4-cycle mode, which may tend to cause knocking.

According to the embodiment of the invention, the timing for opening the intake valve is delayed such that the amount of the combusted fuel gas to be blown back into the intake pipe during the overlap period at which both the intake and the exhaust valves are opened becomes smaller than that in the second operation mode. As a result, the amount of the combusted fuel gas that resides in the combustion chamber can be reduced. This may decrease the temperature of the air fuel mixture within the combustion chamber, suppressing knocking.

It is preferable that the exhaust valve opening timing in the transition cycle is set to a predetermined timing that is close to the exhaust valve opening timing in the first operation mode. It is also preferable that the fuel is injected in the first operation mode upon a transition from the first operation mode to the transition cycle, and the exhaust valve is opened in the transition cycle after combustion of the fuel.

According to the embodiment, the combustion of the fuel injected in the first operation mode before start of the transition cycle may provide the same level of energy as the one obtained in the first operation mode. This may reduce the torque change upon transition to the switched operation mode.

In the case where the first operation mode is the 2-cycle mode, and the second operation mode is the 4-cycle mode, it is preferable to open the exhaust valve of one of the combustion chambers in the transition cycle subsequent to combustion of the fuel injected in the first operation mode upon transition from the first operation mode to the transition cycle, and open the exhaust valve of the other combustion chamber in the transition cycle at a timing 720°/N delayed from the timing at which the exhaust valve is opened in the transition cycle in the one of the combustion chambers where the transition cycle is started. This makes it possible to realize the engine operation in which the explosion stroke occurs at uniform interval in the respective combustion chambers.

In the case where the first operation mode is the 2-cycle mode under the self ignition priority control, and the second operation mode is the 4-cycle mode under the self ignition priority control, it is preferable to make an actual compression ratio in the transition cycle higher than that in the second operation mode.

In the case where the engine is operated in the 2-cycle mode and 4-cycle mode under the same ignition control (self ignition control or spark ignition control), the temperature of the combusted fuel gas in the 2-cycle mode is lower than the temperature in the 4-cycle mode. As the temperature of the combusted fuel gas is kept low immediately after switching of the operation mode from the 2-cycle mode to the 4-cycle mode, the misfire is likely to occur. However, the transition cycle at a higher actual compression ratio may prevent the misfire upon switching of the operation mode.

It is preferable to make the intake valve closing timing in the transition cycle is earlier than the valve closing timing in the second operation mode. According to the embodiment, the actual compression ratio can be increased, preventing the misfire.

In the case where the first operation mode is 2-cycle mode under the self ignition priority control, and the second operation mode is the 4-cycle mode under the self ignition priority control, it is preferable to make the exhaust valve closing timing in the transition cycle earlier than that in the second operation mode. This may increase the combusted fuel gas that resides in the combustion chamber. As a result, the temperature of the air fuel mixture within the combustion chamber may be increased, preventing the misfire.

In the case where each of the transition cycle and the second operation mode has a period at which the intake valve and the exhaust valve are kept closed from closing of the exhaust valve to opening of the intake valve, it is preferable that the intake valve opening timing in the transition cycle is delayed from that in the second operation mode.

According to the embodiment, in the case where the engine is operated in the 4-cycle mode for the period at which both the intake and the exhaust valves are closed until the intake valve opens, when the exhaust valve closing timing is advanced, the piston work with respect to the gas within the combustion chamber may be increased. According to the embodiment, the intake valve opening timing may be delayed so as to collect more energy derived from the piston work with respect to the gas as the downward movement of the piston, that is, rotating motion of the crankshaft. This makes it possible to increase the engine operation efficiency.

In the case where the first operation mode is the 4-cycle mode, and the second operation mode is the 2-cycle mode, it is preferable that the injection quantity of the fuel in the transition cycle is in a range between ½ and ⅔ of the injection quantity of the fuel injected by the fuel injection unit in the first operation mode, and the period from opening of the exhaust valve to opening of the intake valve in the transition cycle is shorter than the period in the second operation mode.

In the transition cycle as aforementioned, the intake valve opens at the high pressure within the combustion chamber. This may allow larger amount of the combusted fuel gas into the intake pipe so as to be returned to the combustion chamber compared with the second operation mode. As a result, the amount of the combusted fuel gas that resides in the combustion chamber can be increased such that air to be newly introduced into the combustion chamber may be reduced. This may prevent misfire resulting from the combustion in a substantially fuel lean state even if the fuel injection quantity is decreased for reducing the torque change.

In the case where the first operation mode is the 4-cycle mode under the self ignition priority control, and the second operation mode is the 2-cycle mode under the self ignition priority control, it is preferable that a period taken from opening of the intake valve to closing of the exhaust valve in the transition cycle is longer than the period in the second operation mode.

The temperature of the combusted fuel gas in the 4 cycle operation under the ignition control either in the self ignition or spark ignition is higher than that in the 2-cycle operation under the same ignition control. The temperature of the combusted fuel gas may be kept higher immediately after switching of the engine operation from the 4-cycle mode to the 2-cycle mode. This may cause the engine to perform the self ignition before the piston moves up to reach the sufficient level. According to the embodiment, the combusted fuel gas that resides in the combustion chamber is reduced to decrease the temperature of the air fuel mixture within the combustion chamber so as to prevent the self ignition at an earlier stage.

In the case where the first operation mode is the 4-cycle mode under the self ignition priority control, and the second operation mode is the 2-cycle mode, it is preferable that an actual compression ratio in the transition cycle is lower than the actual compression ratio in the second operation mode. This makes it possible to prevent the self ignition at an earlier stage.

In the case where the first operation mode is the 4-cycle mode under the combustion ignition control, and the second operation mode is the 4-cycle mode under the self ignition priority control, it is preferable that the exhaust valve closing timing in the transition cycle is delayed from that in the second operation mode.

In the engine operation either in the 2-cycle mode or 4-cycle mode, the temperature of the combusted fuel gas under the spark ignition control may tend to become higher than that under the self ignition control. The spark ignition combustion can be performed only in the case where the degree of the fuel lean state is relatively low, that is, in the fuel rich state. As the temperature of the combusted fuel gas is kept higher immediately after switching from the spark ignition control to the self ignition control, knocking is likely to occur.

According to the embodiment, exhaust valve closing timing is delayed such that the combusted fuel gas that resides in the combustion chamber is less than that in the second operation mode. As a result, the temperature of the air fuel mixture within the combustion chamber becomes lower than that in the second operation mode, preventing knocking.

In the case where the first operation mode is the 4-cycle mode under the combustion ignition control, and the second operation mode is the 4-cycle mode under the self ignition priority control, it is preferable that an actual compression ratio in the transition cycle is lower than that in the second operation mode. The embodiment makes it possible to prevent knocking.

In the case where the first operation mode is the 4-cycle mode under the self ignition priority control, and the second operation mode is the 4-cycle mode under the combustion ignition control, it is preferable that an actual compression ratio in the transition cycle is higher than that in the second operation mode.

In the cycle immediately after switching from the self ignition control to the spark ignition control, the temperature of the combusted fuel gas has been kept low, resulting in misfire. In the aforementioned embodiment, however, a high actual compression ratio makes it possible to prevent the misfire upon switching of the operation mode.

In an engine with variable cycle switchable between a 4-cycle mode and a 2-cycle mode, an area defined by a required load and an engine speed is divided into a first area where the required load is higher than a predetermined value, a second area where the required load is lower than the predetermined value, a third area between the first area and the second area, where the engine speed is lower than a predetermined value, and a fourth area between the first area and the second area, where the engine speed is higher than the predetermined value.

It is preferable that the engine executes a first operation mode performed in the first area and the second area, and the engine is operated in the 4-cycle mode under a combustion ignition control with an ignition unit at a predetermined timing before top dead center of a piston of the engine, a second operation mode performed in the third area, and the engine is operated in the 2-cycle mode under a self ignition priority control that executes one of the ignition without the ignition unit and the ignition with the ignition unit at a timing delayed from the timing under the combustion ignition control, and a third operation mode performed in the fourth area, and the engine is operated in the 4-cycle mode under the self ignition priority control. The embodiment makes it possible to perform efficient operation with reduced NOx emission.

It is to be understood that the invention may be modified in various forms, for example, it may be applied in the form of, for example, a variable cycle engine, a vehicle or a mobile object using such engine, an operation mode switching method, an operation mode switching device, a computer program for realizing the switching device or functions of the switching method, a recording medium that stores the computer program, data signals containing the computer program in the carrier wave, and the like.

DETAILED DESCRIPTION OF PREFERRED EMBODIMENTS

Embodiments of the invention will be described in accordance with the following order such that the operation and effect of the invention can be further clarified.

A. First Embodiment:

A-1. Structure:

A-2. Operation in the operation mode in accordance with operation area:

A-3. Valve operation timing in each operation mode:

A-4. Transition from 4-cycle mode under spark ignition control to 2-cycle mode under self ignition control:

A-5. Transition from 2-cycle mode under self ignition control to 4-cycle mode under spark ignition control:

B. Second Embodiment:

B-1. Transition from 2-cycle mode under self ignition control to 4-cycle mode under self ignition control:

B-2. Transition from 4-cycle mode under self ignition control to 2-cycle mode under self ignition control:

C. Third Embodiment:

C-1. Transition from 4-cycle mode under spark ignition control to 4-cycle mode under self ignition control:

C-2. Transition from 4-cycle mode under self ignition control to 4-cycle mode under spark ignition control:

D. Fourth Embodiment:

D-1. Transition from 4-cycle mode under spark ignition control to 2-cycle mode under self ignition control:

D-2. Transition from 2-cycle mode under self ignition control to 4-cycle mode under spark ignition control:

E. Modified Example:

A. First Embodiment

A-1. Structure

Figure 1:
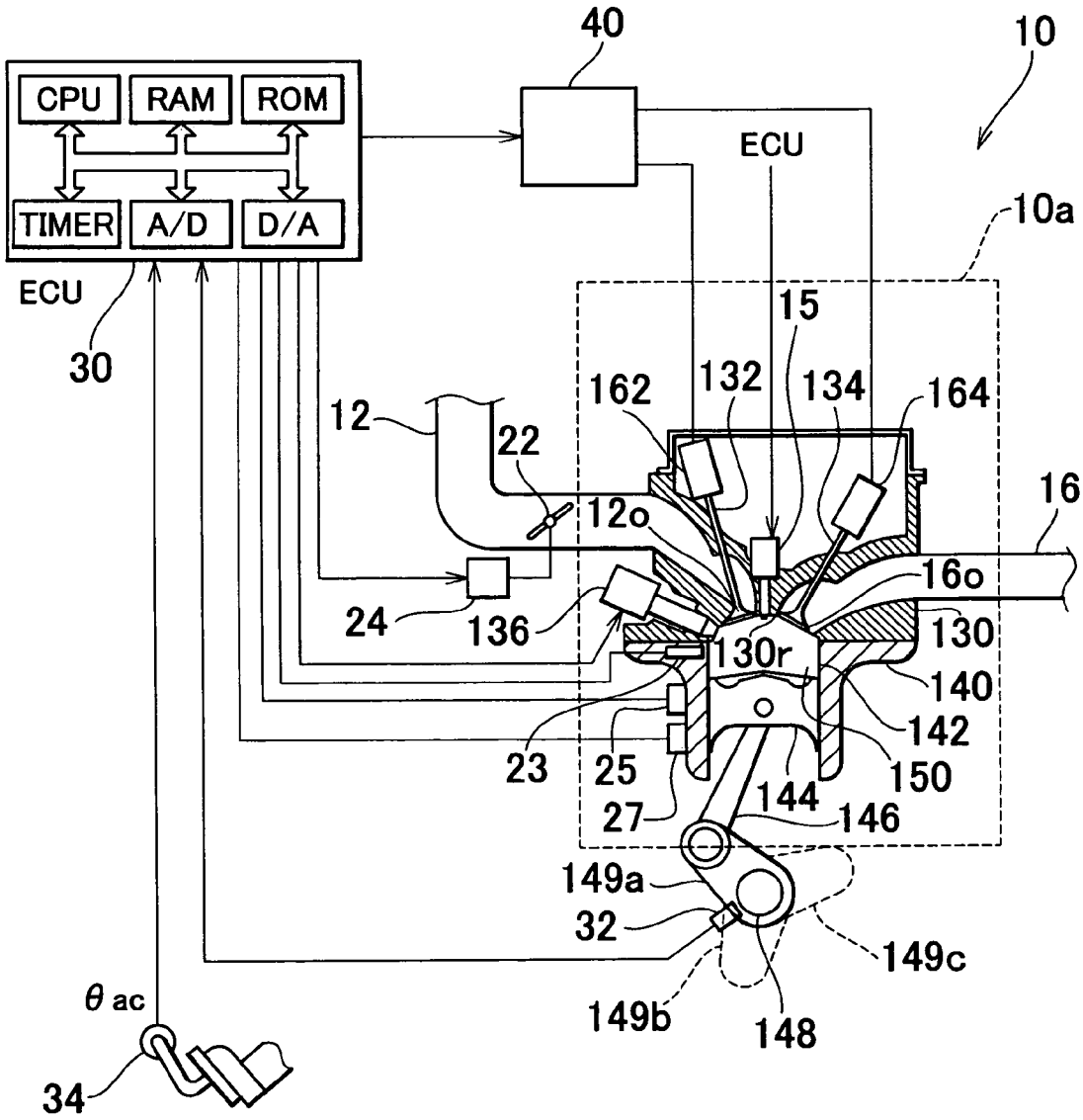
FIG. 1 is a view that conceptually shows a structure of an engine according to a first embodiment.

FIG. 1 schematically shows a structure of an engine 10 according to a first embodiment. The engine 10 can be operated in a mode that is switchable among a plurality of operation modes including 4-cycle mode and 2-cycle mode. In the 4-cycle mode operation or 4 stroke/cycle mode operation, 4 piston strokes (intake, compression, expansion, exhaust) constitute a cycle. In the 2-cycle mode or 2 stroke/cycle operation, a scavenging/compression stroke and an expansion stroke during a single reciprocation of the piston constitute a cycle.

FIG. 1 shows a combustion chamber unit 10*a* as a cross section of a substantially center part of a combustion chamber 150. A main body of the engine 10 is formed by assembling a cylinder head 130 on a top portion of a cylinder block 140. The cylinder block 140 and the cylinder head 130 constitute a cylinder 142 through which a piston 144 slidably moves up and down. The cylinder head 130 has a ceiling portion 130*r* that faces the piston on its extension in the reciprocating direction. The combustion chamber 150 is defined by the ceiling portion 130*r*, a top portion of the piston 144 and a side wall of the cylinder 142.

The piston 144 is connected to a crankshaft 148 via a connecting rod 146. The piston 144 slidably moves up and down within the cylinder 142 accompanied with a rotating motion of the crankshaft 148.

The cylinder head 130 includes an intake passage 12 that admits intake air into the combustion chamber 150, a spark plug 136 for ignition of air fuel mixture within the combustion chamber 150, and an exhaust passage 16 through which combustion gas generated within the combustion chamber 150 is discharged. Oxygen containing air that has passed through the intake passage 12 flows into the combustion chamber 150 via an intake port 12*o* formed in the ceiling portion 130*r* of the cylinder head 130. The combusted fuel gas within the combustion chamber 150 is discharged from the exhaust passage 16 via an exhaust port 16*o* formed in the ceiling portion 130*r*.

The cylinder head 130 is provided with an intake valve 132 and an exhaust valve 134. The intake valve 132 and the exhaust valve 134 are driven by electric actuators 162, 164 respectively at appropriate timings such that the intake port 12*o* and the exhaust port 16*o* are operated synchronously with the movement of the piston 144.

The intake passage 12 is provided with a throttle valve 22 that is controlled to be opened at an appropriate degree by driving an electric actuator 24 so as to control the amount of air admitted into the combustion chamber 150.

The engine 10 is provided with a fuel injection unit 15 mounted on the cylinder head 130 such that gasoline is directly injected into the combustion chamber 150. The fuel injection unit 15 is capable of controlling quantity of the gasoline to be injected per unit of time by changing a pressure at which the gasoline is injected. The gasoline is stored in a gasoline tank (not shown) and pumped up by a fuel pump (not shown) so as to be supplied into the fuel injection unit 15.

An operation of the engine 10 is controlled by an electronic control unit (ECU) 30 for executing an engine control. The ECU 30 is formed as a known microcomputer including CPU, RAM, ROM, A/D converting element, D/A converting element, and the like which are connected with one another via bus. The ECU 30 detects an engine speed Ne or an accelerator opening degree θac, based on which the opening of the throttle valve 22 is controlled to an appropriate opening degree. The engine speed Ne can be detected by a crank angle sensor 32 mounted on a top end of the crankshaft 148. The accelerator opening degree θac can be detected by an accelerator opening sensor 34 that is built in the accelerator pedal. The ECU 30 executes a control operation for appropriately driving the fuel injection unit 15, a spark plug 136 and the like.

The ECU 30 detects the engine speed Ne or the accelerator opening degree θac, based on which the operation mode is switched among a plurality of operation modes including 4-cycle mode and 2-cycle mode. In the 4-cycle mode operation of the engine, a single cycle of intake, combustion, and discharge with respect to the air fuel mixture is performed during the period taken for the piston to reciprocate twice. In the 2-cycle mode operation of the engine, a single cycle of intake, combustion, and discharge with respect to the air fuel mixture is performed during the period taken for the piston to reciprocate once. Switching of the operation mode between 4-cycle mode and 2-cycle mode can be performed by changing the timing for operating the intake valve 132 and the exhaust valve 134 synchronously with the motion of the piston 144, and by changing the timing for driving the fuel injection unit 15, the spark plug 136 and the like.

More specifically, the ECU 30 sets the timing for operating the intake valve 132 and the exhaust valve 134 based on the engine speed Ne and the accelerator opening degree θac. The set timing for operating the intake valve 132 and the exhaust valve 134 is transmitted to a drive circuit 40 for an electromagnetically driven valve. The drive circuit 40 drives the electric actuators 162, 164 at an appropriate timing in accordance with the transmitted timing.

Although the combustion chamber unit 10*a* is only shown and described in FIG. 1 just for simplifying the explanation, the engine actually includes 3 sets of the combustion chamber units each having the cylinder 142, cylinder head 130, and piston 144. The intake passage 12 is divided into 3 passages downstream of the throttle valve 22. Each divided passage is connected to each of the combustion chamber units 10*a* to 10*c*, respectively. The combustion chamber unit is shown as an area defined by a dashed line in FIG. 1. Each structure within the area defined by the dashed line is independently provided in the respective combustion chamber units 10*a* to 10*c* except the crankshaft 148. When the structure of each of the combustion chamber units 10*a* to 10*c* has to be independently described, the corresponding reference numeral of such structure will be added with one of a, b, and c.

The pistons 144*a* to 144*c* of the combustion chamber units 10*a* to 10*c* are connected to a single crankshaft via connecting rods 146*a* to 146*c* each connected thereto. The crankshaft 148 includes crank arms 149*a* to 149*c* each having a different phase by 120°. The connecting rods 146*a* to 146*c* of the combustion chamber units 10*a* to 10*c* are connected to the respective crank arms 149*a* to 149*c* each having a different phase by 120°. Each of the connecting rods 146*a* to 146*c* of the combustion chamber units 10*a* to 10*c* is connected to the crank arms 149*a* to 149*c* having the different phase by 120°. Accordingly each of the pistons 144*a* to 144*c* reciprocates within the cylinder at a shifted phase by 120° so as to rotate the common crankshaft 148.

Figure 2:
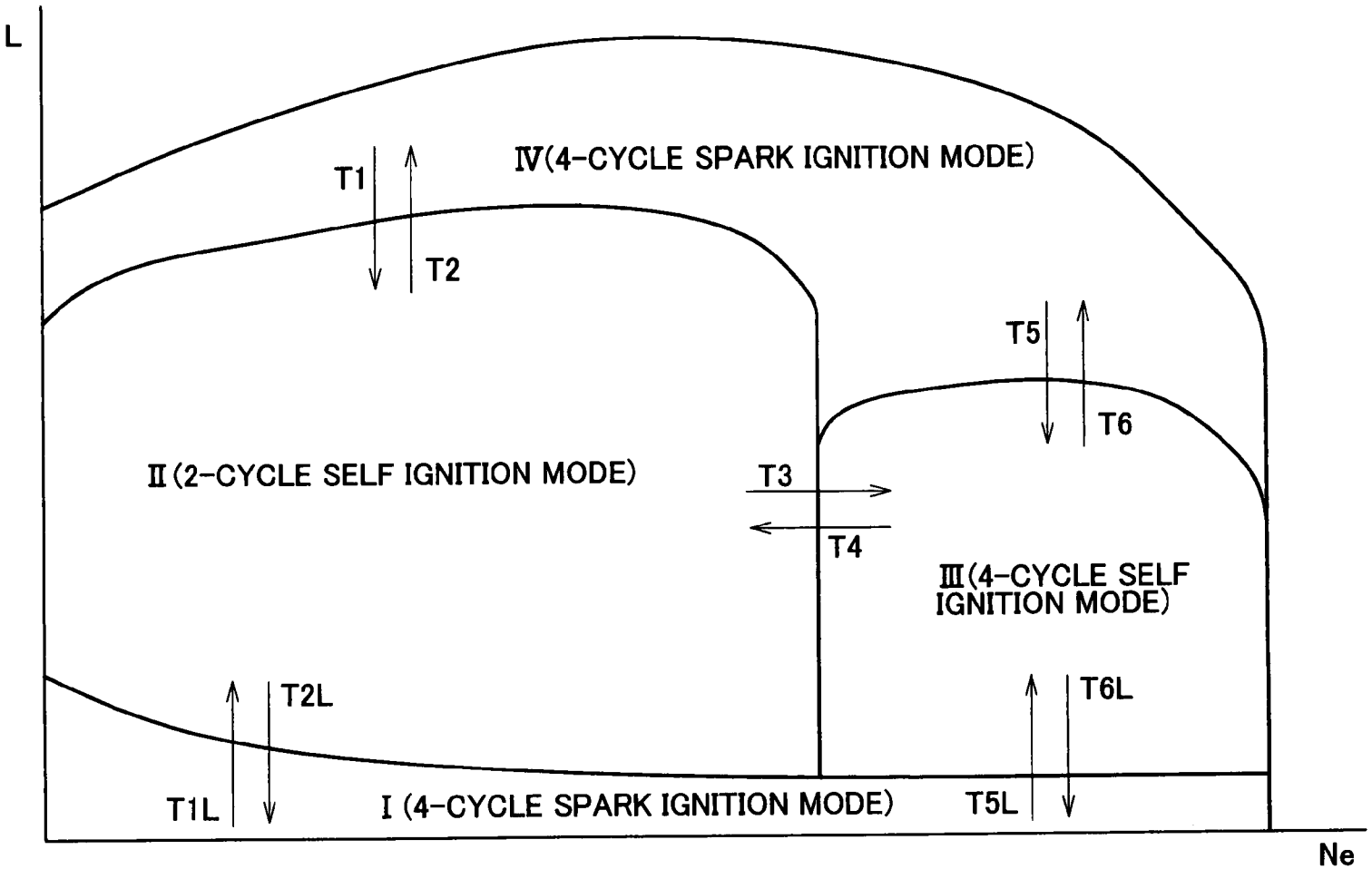
FIG. 2 is an explanatory view of a map that represents different operation modes of the engine in accordance with operating conditions.

A-2. Operation in the Operation Mode in Accordance with Operation Area:

FIG. 2 is an explanatory view that shows a map containing different operation modes each set in accordance with operating conditions of the engine. An x-axis of the map shown in FIG. 2 represents a rotating number Ne of the crankshaft 148 per unit of time. A y-axis of the map shown in FIG. 2 represents a required load (required torque) L of the engine 10, which is set by the ECU 30 based on the accelerator opening degree. The ECU 30 stores the map shown in FIG. 2 in the ROM so as to determine the operation mode in accordance with the map.

The ECU 30 serves to operate the engine in the 4-cycle mode under the spark ignition control where ignition is performed with the spark plug 136 when the engine operation is in a low load (area I) and a high load (area IV). The ECU 30 serves to operate the engine under the self ignition control that allows the fuel to be self ignited when the engine operation is in a medium load (areas II and III). The ECU 30 serves to operate the engine in 2-cycle mode under the self ignition control when the engine operation is in the medium load at a relatively lower engine speed (area II). The ECU 30 serves to operate the engine in 4-cycle mode under the self ignition mode when the engine is operated at a relatively higher engine speed (area III).

Upon the self ignition, the fuel combustion within the combustion chamber rapidly proceeds within a short period. Accordingly, unlike the generally performed combustion by the spark ignition, the combustion by the self ignition is not susceptible to the influence of the generally performed combustion by the spark ignition where the area at which the fuel is combusted at an initial stage is held at a high temperature for an extended period of time. Unlike the combustion by the spark ignition, the combustion by the self ignition allows the air fuel mixture to be combusted in a short period of time even in the fuel lean state. This may reduce quantity of generated NOx to a substantially lower level compared with the combustion by the spark ignition. As a result, it is preferable to perform the combustion under the self ignition control over an operation area as wide as possible.

In the operation area in the low required load L, quantity of air admitted into the combustion chamber and quantity of the fuel are small. Accordingly the pressure of the air fuel mixture within the combustion chamber upon start of compression is reduced. This may tend to interfere in the self ignition of the air fuel mixture even in the state of compression with the piston. Therefore, the engine is operated in the 4-cycle mode under the spark ignition control in the area in the low required load.

The combustion by the self ignition can proceed rapidly in a short period of time. The combustion by the self ignition in the area in the high required load, thus, may increase the combustion noise compared with the combustion by the spark ignition. Accordingly the engine is operated in 4-cycle mode under the spark ignition control in the area in the high required load.

The engine is operated under the self ignition control in the medium load area (areas II and III). In the area II at the relatively lower engine speed, the engine is operated in 2-cycle mode under self ignition control, and in the area III at the relatively higher engine speed, the engine is operated in 4-cycle mode under self ignition control. As the engine speed increases, the combusted fuel gas is sufficiently discharged during the scavenging period in 2-cycle mode, and it is, therefore, difficult to perform the intake stroke. The scavenging period represents the time at which the exhaust valve 134 and the intake valve 132 are both opened in the engine operation in 2-cycle mode.

The term "2-cycle mode under self ignition control" or "4-cycle mode under self ignition control" does not always represent the case where the combustion by self ignition always occurs in the aforementioned mode. That is, there may be the case where the combustion by spark ignition occurs even in 2-cycle mode under self ignition control or in 4-cycle mode under self ignition control.

A-3. Valve Operation Timing in each Operation Mode

Figure 3:
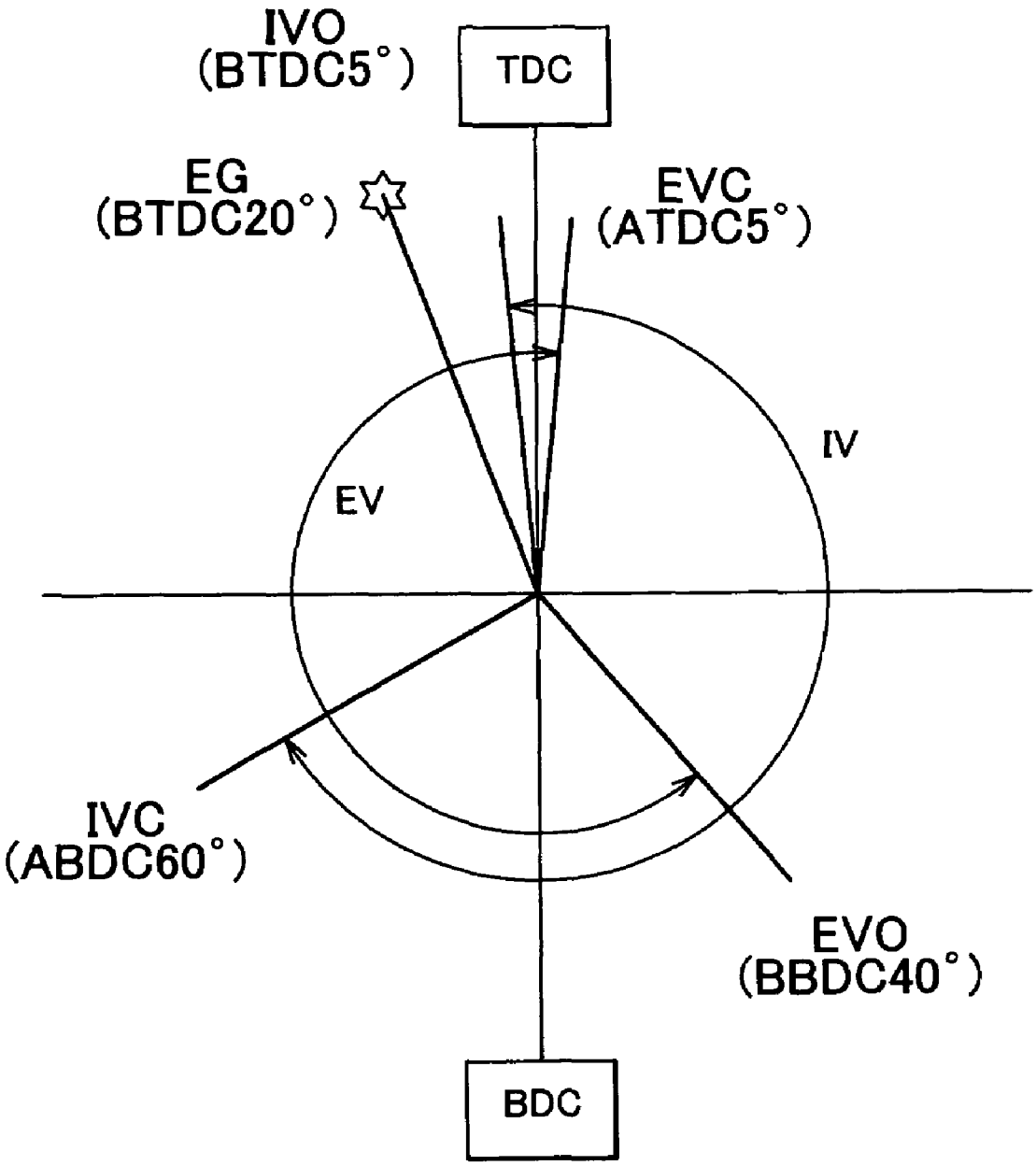
FIG. 3 is an explanatory view that shows a timing for operating intake and exhaust valves synchronously with a piston operation in a 4-cycle spark ignition mode in a low load.

FIG. 3 is a view that represents the timing for operating the intake valve 132 and the exhaust valve 134 synchronously with the motion of the piston 144 in the engine operation in 4-cycle mode under spark ignition control in the low load area (area I shown in FIG. 2). Referring to FIG. 3, "TDC" represents the timing at which the piston reaches the top dead center, and "BDC" represents the timing at which the piston reaches the bottom dead center. The timing for opening the intake valve 132 is represented by "IVO", and the timing for closing the intake valve 132 is represented by "IVC". The timing for opening the exhaust valve 134 is represented by "EVO", and the timing for closing the exhaust valve 134 is represented by "EVC". FIG. 3 shows the timing EG for igniting the mixture of gasoline with the spark plug 136.

Referring to FIG. 3, each of the timing for operating the valves and for spark ignition is corresponded to the rotating angle of the crankshaft 148 for the period taken for the piston 144 to reciprocate between the TDC and BDC. It can be expressed as, for example, 5° before TDC, or 40° after BDC. In FIG. 3, "BTDC" represents before TDC, and "ATDC" represents after TDC. The term "BBDC" represents before BDC and "ABDC" represents after BDC.

As shown in FIG. 3, when the engine is operated in 4-cycle mode under spark ignition control in the low load, the intake valve 132 is opened when the piston reaches BTDC 5°. In this moment, the exhaust valve 134 is kept opened. When the piston 144 goes over TDC to reach ATDC 5°, the exhaust valve 134 is closed. The time held at the piston position between BTDC 5° and ATDC 5° where both the intake valve 132 and the exhaust valve 134 are opened is referred to as an overlap period. Thereafter, the piston 144 goes down to exceed the BDC and goes up to reach ABDC 60°, the intake valve 132 is closed. Air is admitted from the intake passage 12 (intake stroke) while the piston 144 is moving down in the state where the intake valve 132 is opened, such that the fuel injection is performed by the fuel injection unit 15 at a predetermined timing. It is assumed herein that the fuel injection is performed at a predetermined time interval at around ATDC 30°. The piston 144 further moves up to compress the fuel gas within the combustion chamber 150 (compression stroke), and reaches BTDC 20° where the spark plug 136 is operated to ignite the fuel within the combustion chamber 150.

The combustion of the fuel within the combustion chamber 150 by spark ignition forces the piston 144 down (explosion stroke). When the piston 144 reaches the timing BTDC 40°, the exhaust valve 134 is opened. When the piston 144 goes up again to reach the timing ATDC 5°, the exhaust valve 134 is closed. The combusted fuel gas is discharged from the exhaust passage 16 (exhaust stroke) while the exhaust valve 134 being opened and the piston 144 moving up.

The engine is operated repeatedly in the same cycle. The range for which the intake valve 132 is opened is represented by a circular arc IV with arrow ends. The range for which the exhaust valve 134 is opened is represented by a circular arc EV with both ends arrowed.

Figure 4:
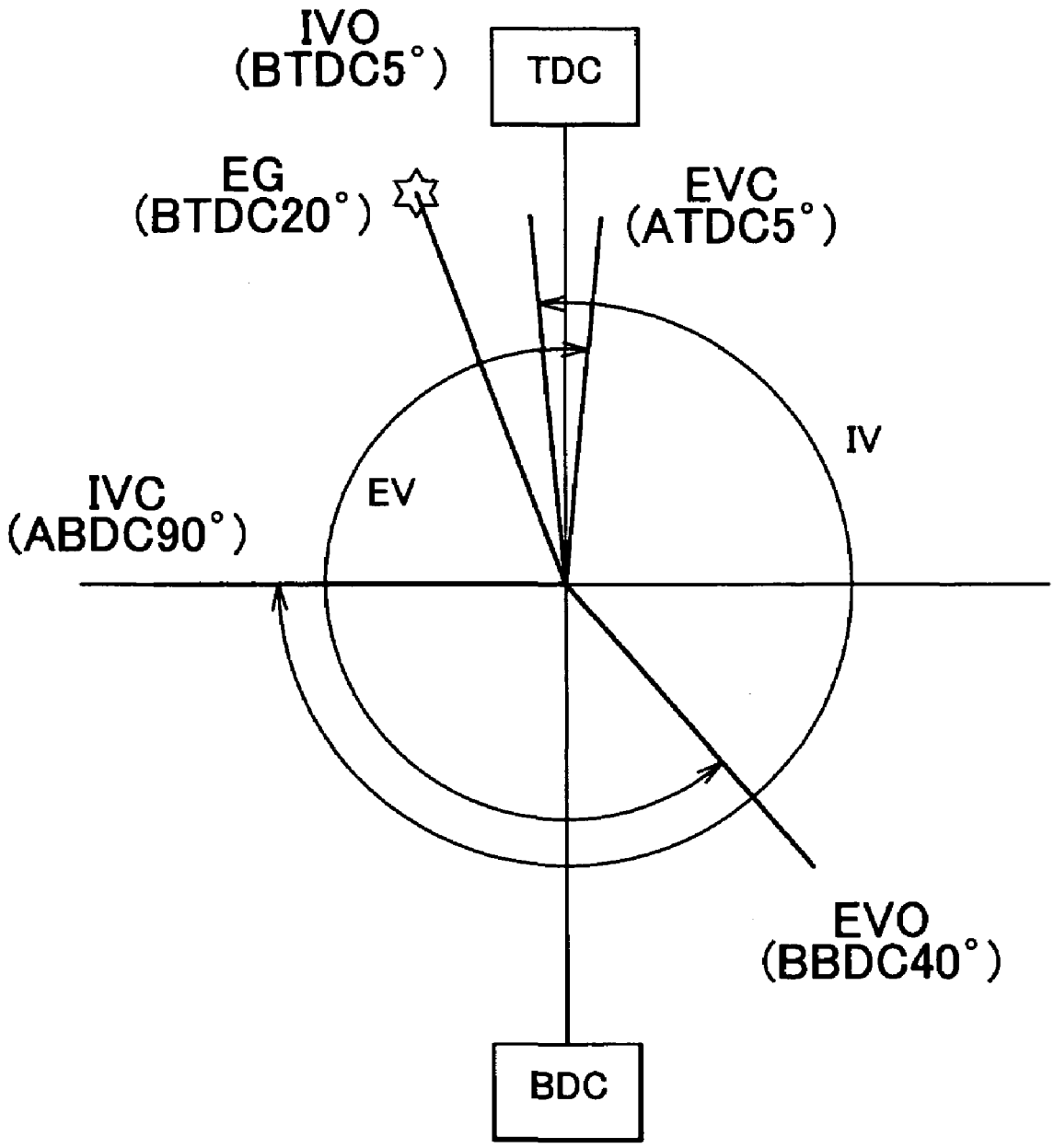
FIG. 4 is an explanatory view that shows timing for operating the intake and exhaust valves synchronously with a piston operation in a 4-cycle spark ignition mode in a high load.

FIG. 4 is a view that represents the timing for operating the intake valve 132 and the exhaust valve 134 synchronously with the motion of the piston 144 when the engine is in 4-cycle mode under spark ignition control in the high load (area IV as shown in FIG. 2). Each description of the view is the same as that shown in FIG. 3. When the engine is operated in 4-cycle mode under spark ignition control in high load, the intake valve 132 is closed at the timing ABDC 90° rather than ABDC 60°. Other features are the same as those represented by the operation timing of each valve in the engine operation in 4-cycle mode under spark ignition control in the low load as shown in FIG. 3.

Figure 5:
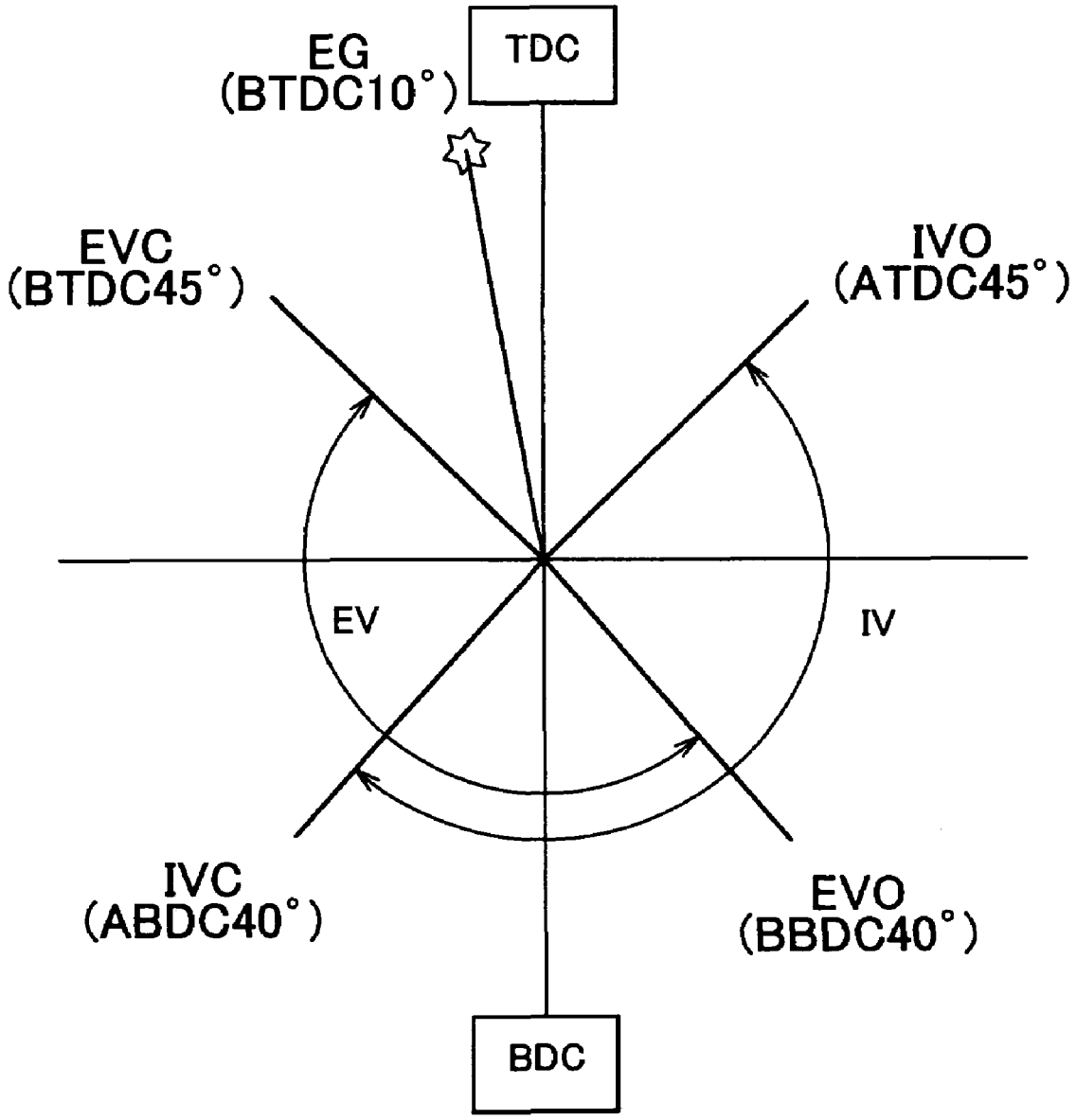
FIG. 5 is an explanatory view that shows a timing for operating the intake and exhaust valves synchronously with a piston operation in a 4-cycle self ignition mode at a high engine speed in a medium load.

FIG. 5 is a view that represents the timing for operating the intake valve 132 and the exhaust valve 134 synchronously with the motion of the piston 144 when the engine is operated in 4-cycle mode under self ignition control in the medium load at high engine speed (area III as shown in FIG. 2). Each description of the view is the same as the one represented in FIG. 3. As shown in FIG. 5, in the engine operation in 4-cycle mode under self ignition control in the medium load at high engine speed, the intake valve 132 is opened when the piston 144 reaches the timing ATDC 45°. At this moment, the exhaust valve 134 has been already closed. Thereafter the piston 144 moves down to exceed BDC, and moves up again. When the piston 144 reaches the timing ABDC 40°, the intake valve 132 is closed. Air is admitted from the intake passage 12 (intake stroke) while the piston 144 moving down such that the fuel injection is performed at a predetermined timing. Then the piston 144 further moves up to compress air and the fuel within the combustion chamber 150 (compression stroke). The fuel is self ignited at around BTDC 10° to force the piston 144 to move down (explosion stroke).

The spark ignition may be performed by the spark plug 136 even in the engine operation in 4-cycle mode under self ignition control. The ignition timing, however, becomes BTDC 10° which is different from that of the engine operation in 4-cycle mode under spark ignition control. As the spark ignition by the spark plug 136 can be performed at the aforementioned timing in the engine operation in 4-cycle mode under self ignition control, the misfire may be prevented even if no self ignition occurs.

In the engine operation in 4-cycle mode under self ignition control, the ignition is performed at the timing behind the spark ignition timing (see FIGS. 3 and 4). This may prevent the air fuel mixture from being combusted by propagated flame owing to the spark ignition by the spark plug 136 prior to the self ignition even in the state where self ignited combustion is allowed. Accordingly this makes it possible to cause the self ignition combustion that generates less quantity of NOx with priority.

When the piston 144 is forced down to reach the timing BBDC 40°, the exhaust valve 134 is opened. When the piston 144 moves up to reach the timing BTDC 45°, the exhaust valve 134 is closed. The combusted fuel gas is discharged from the exhaust passage 16 (exhaust stroke) while the piston 144 is moving up, and then, when the piston 144 exceeds over TDC to reach the timing ATDC 45°, the intake valve 132 is opened. The same cycle is repeatedly operated.

Figure 6:
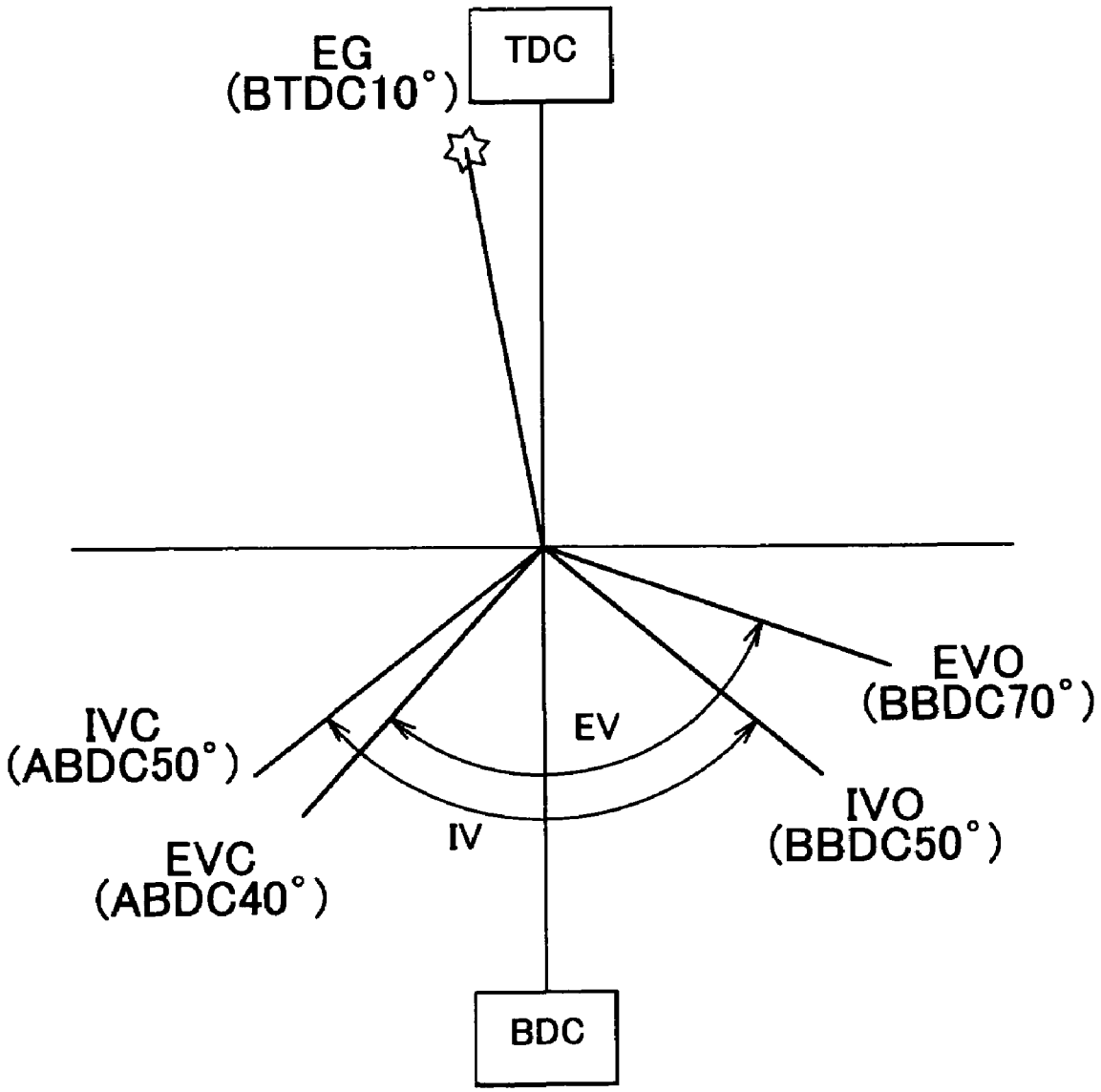
FIG. 6 is an explanatory view that shows a timing for operating the intake and exhaust valves synchronously with a piston operation in a 2-cycle self ignition mode at a low engine speed in a medium load.

FIG. 6 is a view that represents the timing for operating the intake valve 132 and the exhaust valve 134 synchronously with the reciprocating motion of the piston 144 when the engine is operated in 2-cycle mode under self ignition control in the medium load at the low engine speed (area II as shown in FIG. 2). Each description is the same as the one shown in FIG. 3. Referring to FIG. 6, in the engine operation in 2-cycle mode under self ignition control in the medium load at the low engine speed, when the piston 144 moves down to reach the timing BBDC 70°, the exhaust valve 134 is opened. At this moment, the intake valve 132 is kept closed. When the piston 144 further moves down to reach the timing BBDC 50°, the intake valve 132 is opened. When the piston 144 is positioned between the BBDC 70° and BBDC 50°, the exhaust gas is discharged from the exhaust passage 16.

When the piston 144 moves up to reach the timing ABDC 40°, the exhaust valve 134 is closed. When the piston 144 is positioned between BBDC 50° and BBDC 40°, air is admitted from the intake passage 12 and at the same time, the combusted fuel gas is discharged from the exhaust passage 16 (scavenging). The fuel injection is performed at a predetermined timing during scavenging. It is assumed herein that the fuel injection is performed at a predetermined time interval at the timing close to the BDC.

When the piston 144 reaches the timing ABDC 50°, the intake valve 132 is closed. When the piston 144 is positioned between ABDC 40° and ABDC 50°, air is admitted from the intake passage 12. After closing the intake valve 132, the fuel injection is performed from the fuel injection unit 15 at a predetermined timing. Then when the piston 144 moves up to compress air and the fuel within the combustion chamber 150 (compression stroke), the fuel is self ignited at the timing close to the TDC. The piston 144 is then forced down (explosion stroke). The same operation cycle is repeatedly performed thereafter.

As shown in FIGS. 3 and 4, the exhaust valve 134 is closed after the piston exceeds TDC in the engine operation in 4-cycle mode under spark ignition control. That is, when the piston moves to reach the highest position, the exhaust valve 134 is kept opened. As a result, the combusted fuel gas in the previous cycle is discharged from the combustion chamber 150. In the engine operation in 4-cycle mode under self ignition control and 2-cycle mode under self ignition control, the exhaust valve 134 is closed before the piston 144 reaches the TDC as shown in FIGS. 5 and 6. As a result, the combusted fuel gas in the previous cycle cannot be completely discharged out of the combustion chamber 150, and it resides therein. In the engine operation in 4-cycle mode under self ignition control and 2-cycle mode under self ignition control, as the temperature within the combustion chamber 150, thus, is held high, the fuel gas admitted from the intake passage 12 is likely to be self ignited therein.

A-4. Transition from 4-Cycle Mode under Spark Ignition Control to 2-Cycle Mode under Self Ignition Control A transition T1 performed upon switching of the engine operation from 4-cycle mode under spark ignition control in the high load to 2-cycle mode under self ignition control in the medium load at low engine speed will be described hereinafter. The transition step of the operation mode is represented by an arrow T1 shown in FIG. 2.

Figure 7:
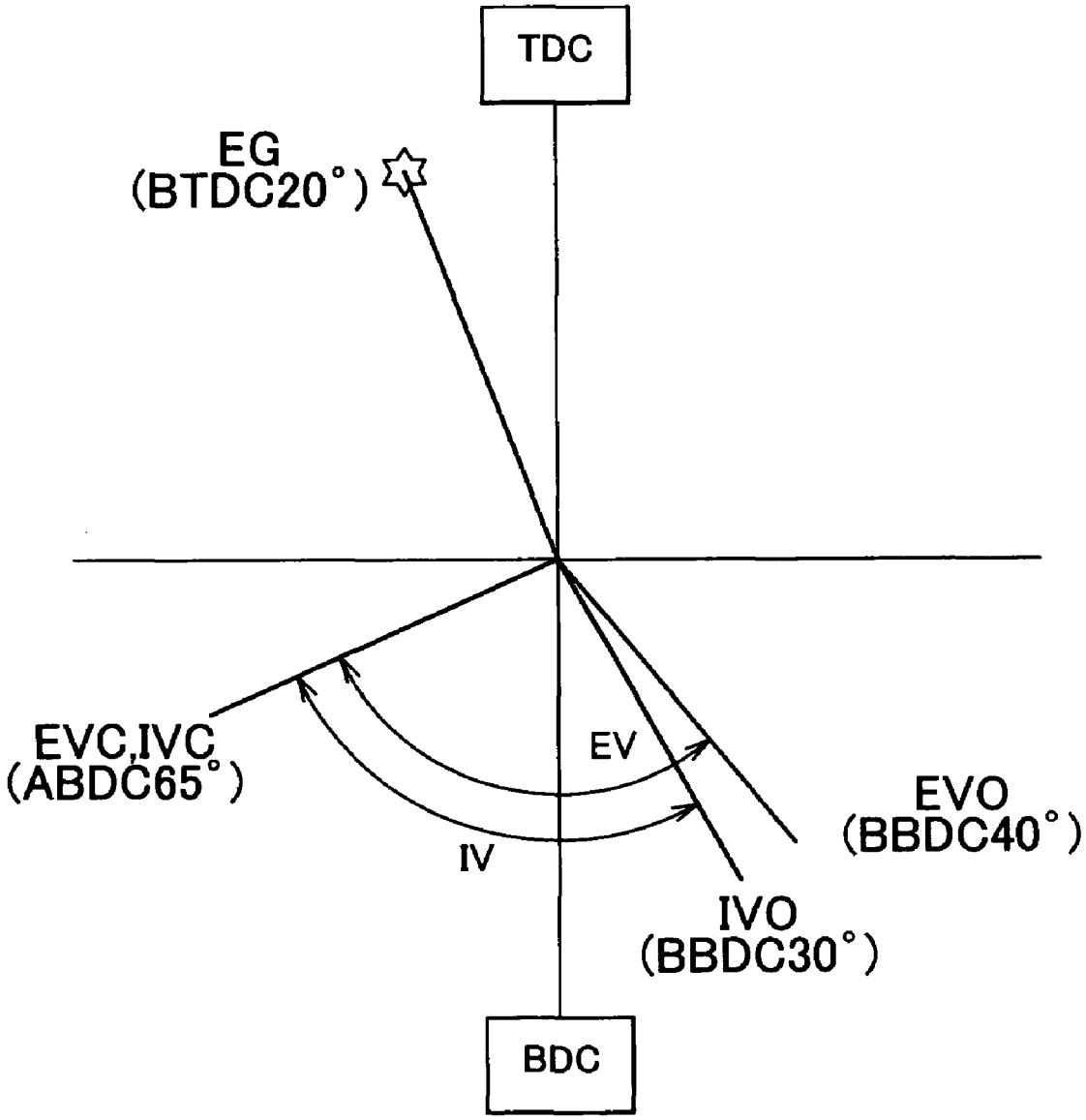
FIG. 7 is an explanatory view that shows a timing for operating the intake and exhaust valves in a transition cycle upon selection from the 4-cycle spark ignition mode in the high load to the 2-cycle self ignition mode in the medium load at low engine speed.

FIG. 7 is a view that represents the timing for operating the intake valve 132 and the exhaust valve 134 in the transition T1 performed upon switching of the engine operation from 4-cycle mode under spark ignition control in the high load to 2-cycle mode under self ignition control in the medium load at low engine speed. In the transition T1 performed upon switching of the engine operation to the 2-cycle mode under self ignition control, the engine operation in 2-cycle mode is performed. The engine operation herein can be distinguished by the "cycle type", that is, 4-cycle mode and 2-cycle mode. Accordingly, in the transition cycle, the engine operation in the cycle type that is the same as the one after switching of the operation mode is performed.

The transition T1 is performed just once between the engine operations in 4-cycle mode under spark ignition control and 2-cycle mode under self ignition control. More particularly, after the combustion is performed in accordance with the 4-cycle mode under spark ignition control prior to the switching operation, the exhaust valve 134 is opened at BBDC 40°, and the intake valve 132 is opened at BBDC 30° in accordance with the timing shown in FIG. 7. Then both the exhaust valve 134 and the intake valve 132 are opened at ABDC 65°, and the spark ignition is performed for combustion at BTDC 20°. Thereafter, the exhaust valve 134 is opened at the timing for the engine operation in 2-cycle mode under self ignition control after the switching operation.

The transition T1 performed upon switching of the engine operation from 4-cycle mode under spark ignition control in the high load to 2-cycle mode under self ignition control in the medium load at low engine speed will be described in comparison with the engine operation in 4-cycle mode under spark ignition mode prior to the switching operation and the engine operation in 2-cycle mode under self ignition control subsequent to the switching operation.

(1) Exhaust Valve Opening Timing and Fuel Injection Quantity

In the transition T1, the timing for opening the exhaust valve 134 is set at BBDC 40°. This timing is the same as that for closing the exhaust valve 134 in the engine operation in 4-cycle mode under spark ignition control prior to the switching operation (see FIG. 4). The transition T1 is capable of obtaining the energy that is the same as the one obtained by the engine operation in 4-cycle mode under spark ignition control prior to the switching operation from the combustion of the fuel injected in the cycle immediately before the transition T1. As a result, the torque transmitted to the crankshaft 148 in the transition T1 becomes the same as that obtained in the engine operation in 4-cycle mode under spark ignition control prior to the switching operation. Therefore, no torque change occurs upon the transition T1 after completion of the engine operation in 4-cycle mode under spark ignition control.

In the transition T1, the timing for opening the exhaust valve 134 is behind the timing in the engine operation in 2-cycle mode under self ignition control after the switching operation by a crank angle of 30° (see FIGS. 6 and 7). The exhaust valve 134 is forced to be opened into the combustion chamber 150 after the pressure within the combustion chamber 150 is reduced. This makes it possible to stably operate the exhaust valve 134 compared with opening of the exhaust valve 134 under the high pressure within the combustion chamber 150.

Quantity of the fuel to be injected in the transition T1 is set to a predetermined value between 50% and 60% of the quantity of the fuel to be injected in the engine operation in 4-cycle mode under spark ignition control before the switching operation.

In the 4 cycle engine operation, the fuel combustion is performed once during two reciprocating motions of the piston 144. In the 2 cycle engine operation, the fuel combustion is performed once during a single reciprocating motion of the piston 144. Assuming that the quantity of the fuel to be combusted at one time in the 4 cycle operation is set to the same value in the 2 cycle operation, the torque may be sharply increased upon switching from 4-cycle mode under spark ignition control to 2-cycle mode under self ignition control.

The fuel quantity to be injected in the transition T1 is in the range between 50% and 60% of the fuel quantity to be injected in the engine operation in 4-cycle mode under spark ignition control prior to the mode transition. When the fuel injected in the transition T1 is combusted, and the resultant energy is derived in the subsequent cycle of the engine operation in 2-cycle mode under self ignition control, such energy (torque) can be substantially the same as that derived from the engine operation in 4-cycle mode under spark ignition control per unit of time prior to the mode transition. Accordingly the operation mode can be switched by smoothly reducing the torque in accordance with the arrow T1 shown in FIG. 2.

(2) Intake Valve Opening Timing and Ignition Timing

In the transition T1, the exhaust valve 134 is opened at BTDC 40°, and then the intake valve 132 is opened after the crankshaft 148 rotates at 10°, that is, at BTDC 30°. In the engine operation in 2-cycle mode under self ignition control after the mode transition, the exhaust valve 134 is opened at BTDC 70°, and then the intake valve 132 is opened after the crankshaft 148 rotates at 20°, that is, at BTDC 50° (see FIG. 6). More specifically, in the transition T1, the intake valve 132 is opened after an elapse of a period from opening of the exhaust valve 134. Such period can be shorter than the period in the engine operation in 2-cycle mode under self ignition control. In other words, the period taken for discharging exhaust gas in the transition T1 is shorter than that in the engine operation in 2-cycle mode under self ignition control after the mode transition.

In the engine operation in 4-cycle mode under spark ignition control prior to the mode transition, the exhaust valve 134 has been already closed as shown in FIG. 4, and the intake valve 132 is opened. The piston passes BDC in the aforementioned state. Thereafter the intake valve 132 is closed at ABDC 90°. The intake valve 132 is held opened when the piston 144 goes up from BDC to the center of the stroke. This may compress not only the air fuel mixture within the combustion chamber 150 but also air and fuel within the intake passage 12. Accordingly, the gas under high pressure flows into the combustion chamber 150 upon next opening of the intake valve 132.

In the engine operation in 2-cycle mode under self ignition control after the mode transition, the exhaust valve 134 is closed at ABDC 40°, and then the intake valve 132 is closed at ABDC 50°. While the exhaust valve 134 is opened, the pressure within the combustion chamber 150 becomes close to the pressure within the exhaust passage 16, that is, close to the atmospheric pressure. The piston 144 goes up only to a small degree for the period taken from closing of the exhaust valve 134 to closing of the intake valve 132. Accordingly compression force applied to the gas within the intake passage 12 is relatively lower than that in the engine operation in 4-cycle mode under spark ignition control. The pressure within the intake passage 12 upon next opening of the intake valve 132 in the engine operation in 4-cycle mode under spark ignition control is higher than that in 2-cycle mode under self ignition control.

In the transition T1 immediately after the engine operation in 4-cycle mode under spark ignition control, if the engine operation is performed at the same valve operation timing as the one in 2-cycle mode under self ignition control, large amount of air is admitted from the intake passage 12 under high pressure into the combustion chamber 150. As a result, the amount of air becomes excessive with respect to the fuel, which may cause misfire.

In the transition T1, the intake valve 132 is opened after an elapse of a relatively short period after opening of the exhaust valve 134. In the transition T1, the pressure within the combustion chamber 150 at a timing where the intake valve 132 is opened cannot be sufficiently decreased to the predetermined level owing to discharge of the exhaust gas into the exhaust passage 16. As a result, the pressure within the combustion chamber 150 is higher than that obtained in the engine operation in 2-cycle mode under self ignition control after the mode transition. As a result, in the transition T1, larger quantity of the combusted fuel gas is blown back into the intake passage 12 compared with the engine operation in 2-cycle mode under self ignition control after the mode transition during scavenging in the transition cycle T1.

The combusted fuel gas that has been returned to the intake passage 12 is further blown into the combustion chamber together with new air. In the transition T1, larger quantity of the combusted fuel gas flows between the combustion chamber 150 and the intake passage 12 compared with the engine operation in 2-cycle mode under self ignition control after the mode transition. As a result, amount of air admitted into the combustion chamber 150 becomes smaller than that in the case where the valves are operated at the same timing as that in the engine operation in 2-cycle mode under self ignition control after the mode transfer.

In the transition T1, the aforementioned operation may reduce quantity of new air to be admitted into the combustion chamber 150. This makes it possible to prevent the excessive increase in the amount of air with respect to the fuel. In the transition T1, the fuel injection quantity becomes smaller than that in the engine operation in 4-cycle mode under spark ignition control prior to the mode transition. This may prevent the misfire even if the pressure in the intake passage 12 becomes higher than that in the engine operation in 2-cycle mode under self ignition control after the mode transition.

In the transition T1, the spark plug 136 is operated for ignition at BTDC 20°. The combustion becomes unstable upon switching of the operation mode. However, in the transition T1, the spark ignition at BTDC 20° may prevent the misfire.

(3) Timing for Closing Intake Valve and Exhaust Valve

In the transition T1, the timing for closing both the exhaust valve 134 and the intake valve 132 is set to ABDC 65°. In the engine operation in 2-cycle mode under self ignition control after the mode transition, the exhaust valve 134 is closed at the timing ABDC 40°, and the intake valve 132 is closed at the timing ABDC 50°. Accordingly the timing for closing both the exhaust valve 134 and intake valve 132 can be set to the timing ABDC 50° (see FIG. 6). In the engine operation in 2-cycle mode under self ignition control after the mode transition, the timing at which compression actually occurs is set to ABDC 50°. While in the transition T1, the timing at which the compression actually occurs is set at ABDC 65°. As a result, the actual compression ratio in the transition T1 is reduced compared with that in the engine operation in 2-cycle mode under self ignition control after the mode transition.

In the engine operation under spark ignition control, the air fuel mixture at excess air ratio of 1 is combusted. That is, the air fuel mixture contains air and fuel in the rate so as to be combusted appropriately. The term "excess air ratio" is an index that indicates how may times the quantity of air actually contained in the air fuel ratio is larger than the optimum quantity of air as being sufficient to be combusted with the fuel. If the excess air ratio is set to 2, the quantity of air is twice the optimum quantity of air as being sufficient to be combusted with the fuel. In the engine operation under self ignition control, the air fuel mixture contains air with the excess air ratio of 1 or greater. In the engine operation under spark ignition control, the temperature of the combusted fuel gas is higher than that under the self ignition control. Upon switching of the operation mode from the spark ignition control into the self ignition control, the temperature of the residual combusted fuel gas in the cycle immediately after the switching is held high. In the aforementioned case, the temperature of the air fuel mixture within the combustion chamber 150 is increased. This may cause self ignition before the piston 144 reaches the position to the sufficiently high level.

In the transition T1, the actual compression ratio is lower than that in the engine operation in 2-cycle mode under self ignition control after the mode transition. The possibility of the self ignition before the piston 144 reaches the position to the sufficiently high level becomes low.

In the transition T1, a larger quantity of the combusted fuel gas is allowed to flow between the combustion chamber 150 and the intake passage 12 compared with that of the combusted fuel gas in the engine operation in 2-cycle mode under self ignition control so as to increase the quantity of the residual combusted fuel gas within the combustion chamber 150. If the quantity of the residual combusted fuel gas becomes excessive, the temperature of the air fuel mixture within the combustion chamber 150 may be increased. In the transition T1, however, the wall portion of the intake passage 12 at the temperature lower than that of the cylinder wall serves to draw heat from the combusted fuel gas that has been returned into the intake passage 12. The resultant temperature of the combusted fuel gas, thus, is lowered. In the transition T1, in spite of increase in the quantity of the residual combusted fuel gas in the combustion chamber 150, the excessive increase in the temperature of the air fuel mixture within the combustion chamber 150 can be suppressed. This makes it possible to prevent self ignition at an earlier stage owing to the increase in the quantity of the residual combusted fuel gas.

The transition T1 as described above is performed upon transition from 4-cycle mode under spark ignition control in the high load to 2-cycle mode under self ignition control in the medium load at low engine speed. The transition T1L may be performed upon transition from 4-cycle mode under spark ignition control in the low load to 2-cycle mode under self ignition control in the medium load at low engine speed (see FIG. 2).

A-5. Transition from 2-Cycle Mode under Self Ignition Control to 4-Cycle Mode under Spark Ignition Control A transition T2 to be performed upon transition from 2-cycle mode under self ignition control in the medium load at low engine speed to 4-cycle mode under spark ignition control in the high load will be described hereinafter. The transition of the operation mode is represented by an arrow T2 as shown in FIG. 2.

Figure 8:
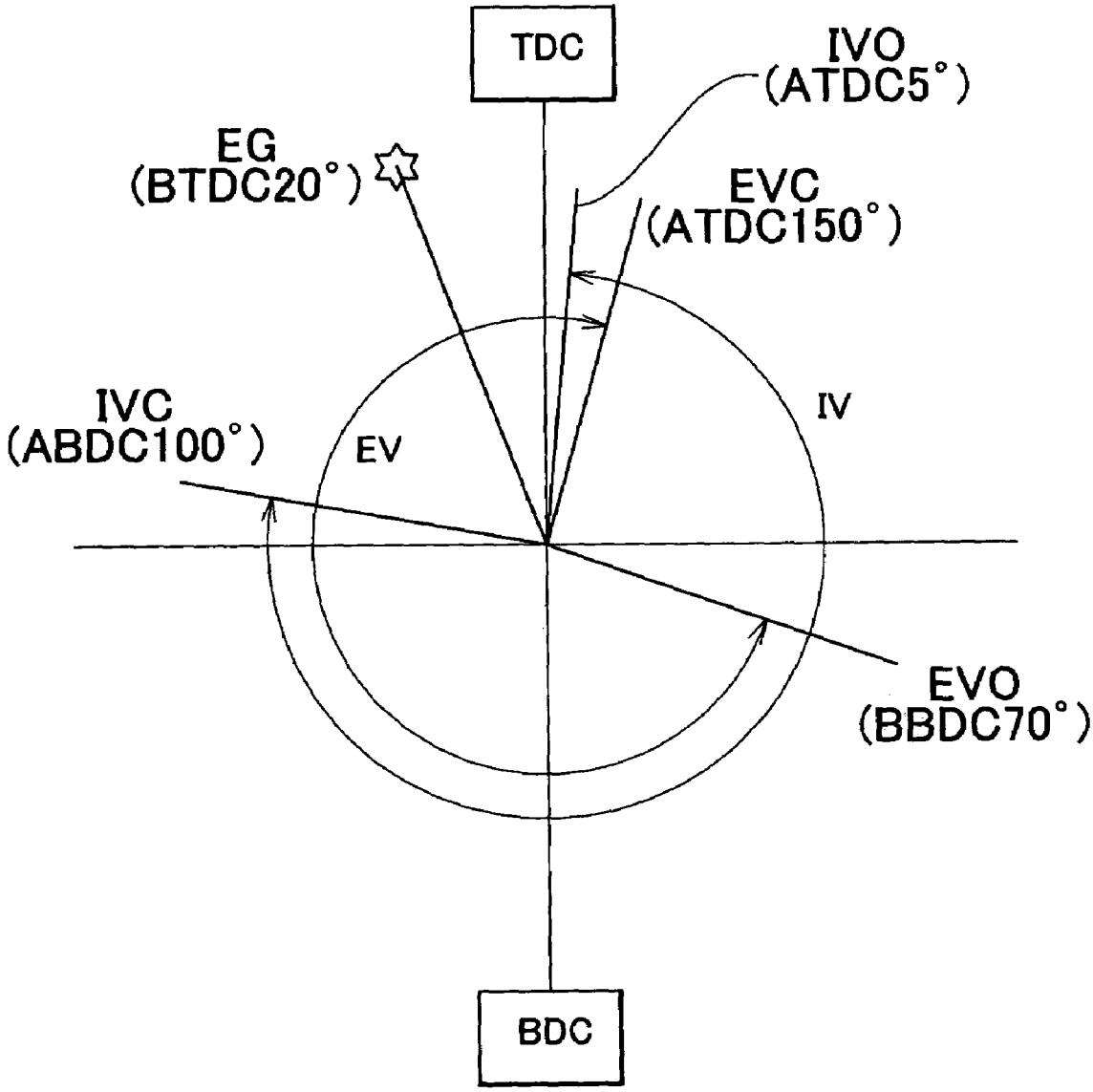
FIG. 8 is an explanatory view that shows a timing for operating the intake and exhaust valves in the transition cycle upon selection from the 2-cycle self ignition mode in the medium load at low engine speed to the 4-cycle spark ignition mode.

FIG. 8 is a view that shows timing for operating the intake valve 132 and the exhaust valve 134. In the transition T2 upon transition to 4-cycle mode under spark ignition control, the 4 cycle operation as being the same as that operated in the mode after the transition is performed.

The transition T2 is performed only once between 2-cycle mode under self ignition control and 4-cycle mode under spark ignition control. More specifically, the engine is operated in 2-cycle mode under self ignition control prior to the transition. Thereafter, according to the timing shown in FIG. 8, the exhaust valve 134 is opened at BBDC 70°, the intake valve 132 is opened at ATDC 5°, and the exhaust valve 134 is closed at ATDC 15°. Then the intake valve 132 is closed at ABDC 100°, and the spark ignition is performed at BTDC 20° for combustion. Further opening of the exhaust valve 134 is performed at the timing in accordance with 4-cycle mode under spark ignition control. The respective operations of the transition T2 will be described compared with those of 2-cycle mode under self ignition control prior to the transition and 4-cycle mode under spark ignition control after the transition.

(1) Exhaust Valve Opening Timing and Fuel Injection Quantity

Referring to FIG. 8, in the transition cycle T2, the timing for opening the exhaust valve 134 is set at BBDC 70° as being the same as 2-cycle mode under self ignition control prior to the mode transition (see FIG. 6). The torque to be transferred to the crankshaft in the transition T2 becomes the same as that in 2-cycle mode under self ignition control prior to the mode transition. Therefore, no torque change occurs upon performance of the transition T2 after completion of 2-cycle mode under self ignition control.

In the transition cycle T2, the fuel is injected into the combustion chamber 150 from the fuel injection unit 15 at the timing close to ATDC 30°. The quantity of the injected fuel in the transition T2 is a predetermined value in the range between 150% and 200% of the quantity of the injected fuel in 2-cycle mode under self ignition control prior to the mode transition. The torque can be smoothly increased in accordance with the arrow T2 shown in FIG. 2 so as to switch the operation mode.

(2) Intake Valve Operation Timing

In the transition cycle T2, the timing for closing the intake valve 132 is set to ABDC 100°. That is, the aforementioned timing is delayed from the timing in 4-cycle mode under spark ignition control after the mode transition by the value corresponding to 10° as the rotating angle of the crankshaft 148 (see FIG. 4). Accordingly, the actual compression ratio in the transition T2 becomes lower than that in the 4-cycle mode under spark ignition control.

In the 4-cycle mode engine operation, the combustion is performed once per two reciprocations of the piston 144. While in the 2-cycle mode engine operation, the combustion is performed once per single reciprocation of the piston 144. At a time when the fuel is combusted in each cycle, the temperature of the cylinder wall in the 2-cycle mode engine operation tends to become higher than that in the 4-cycle mode engine operation. In such a case, the temperature of the cylinder wall may be held high in several cycles immediately after completion of the 2-cycle mode engine operation upon switching of the operation mode from 2 cycle to 4 cycle. In this case, if the engine is operated in 4-cycle mode under spark ignition control subsequent to the 2-cycle mode under self ignition control, knocking may occur. In the transition cycle T2, however, the actual compression ratio is lower than that in the 4-cycle mode under spark ignition control. This makes it possible to reduce occurrence of knocking.

In the transition cycle T2, the timing for opening the intake valve 132 is set at ATDC 5°. The aforementioned timing is delayed from the timing in 4-cycle mode under spark ignition control after transition by the value corresponding to 10° as the rotating angle of the crankshaft 148 (see FIG. 4). In this cycle, the quantity of the combusted fuel gas that has been returned from the intake port 12*o* is reduced compared with that in 4-cycle mode under spark ignition control. As a result, quantity of the high temperature combusted fuel gas that resides in the combustion chamber 150 becomes small in the state where the intake valve 132 is closed. This makes it possible to prevent the knocking.

In the transient cycle T2, the timing for opening the intake valve 132 is delayed, and the intake valve 132 is further opened at a timing when the piston 144 starts moving down upon passing the TDC. This makes it possible to further reduce the quantity of the combusted fuel gas returned into the intake passage 12.

(2) Exhaust Valve Closing Timing and Ignition Timing

In the transition cycle T2, the timing for closing the exhaust valve 134 is set at ATDC 15°. That is, it is delayed from the timing in 4-cycle mode under spark ignition control after the mode transition by the value corresponding to 10° as the rotating angle of the crankshaft 148 (see FIG. 4). The overlap period where both the intake valve 132 and the exhaust valve 134 are held opened is set to the period corresponding to 10° as the rotating angle of the crankshaft 148. In the transition cycle T2, air intake and discharge operations may be performed efficiently using inertia of flow of the gas. This makes it possible to maintain sufficient quantity of air even if the fuel injection quantity is increased.

In the transition cycle T2, the spark plug 136 is operated for ignition at the timing BTDC 20°, thus preventing misfire.

In this embodiment, the transition T2 is performed upon transition from 2-cycle mode under self ignition control in the medium load at high engine speed to 4-cycle mode under spark ignition control in the high load. The transition cycle T2L may be performed upon transition from 2-cycle self ignition mode in the medium load at low engine speed to 4-cycle spark ignition mode in the low load (see FIG. 2).

B. Second Embodiment

In a second embodiment, switching of the operation mode between 2-cycle mode under self ignition control in the medium load at low engine speed and 4-cycle mode under self ignition control in the medium load at high engine speed will be described. The transition from 2-cycle mode under self ignition control to 4-cycle mode under self ignition control is represented by an arrow T3 as shown in FIG. 2. The transition from 4-cycle mode under self ignition control to 2-cycle mode self ignition control is represented by an arrow T4 as shown in FIG. 2. The structure of the engine 10, each operation of the respective modes and the like are the same as those described in the first embodiment.

Figure 9:
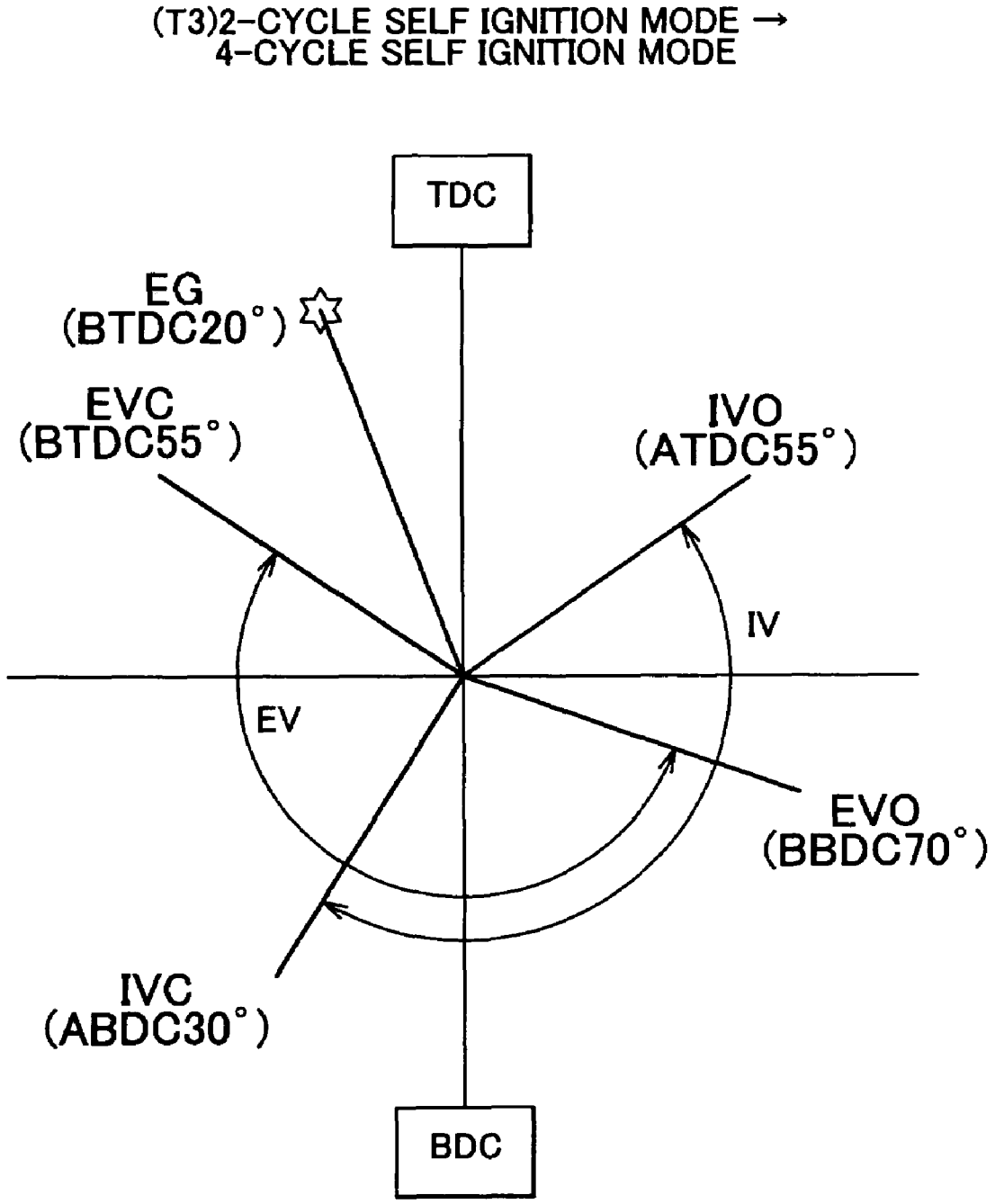
FIG. 9 is an explanatory view that shows a timing for operating the intake and exhaust valves in the transition cycle upon selection from the 2-cycle self ignition mode in the medium load at low engine speed to the 4-cycle self ignition mode in the medium load at high engine speed.

B-1 Transition from 2-Cycle Mode under Self Ignition Control to 4-Cycle Mode under Self Ignition Control FIG. 9 is a view that shows timing for operating both the intake valve 132 and the exhaust valve 134 in the transition cycle T3 upon transition from 2-cycle mode under self ignition control in the medium load at low engine speed to 4-cycle mode under self ignition control in the medium load at high engine speed. In the transition cycle T3 upon transition to 4-cycle mode under self ignition control, the 4-cycle operation is performed. The respective operations shown in FIG. 9 are performed once in the same order from opening of the exhaust valve 134 in the similar way as those performed in the transient cycle T2.

In the transient cycle T3, the timing for opening the exhaust valve 134 is set to BBDC 70° as being the same as in 2-cycle mode under self ignition control before the mode transition (see FIG. 6). This makes it possible to reduce the torque change.

The quantity of the injected fuel in the transition cycle T3 is a predetermined value in the range between 150% and 200% of the quantity of the injected fuel in 2-cycle mode under self ignition control before the mode transition. This makes it possible to smoothly switch the operation mode in accordance with the arrow T3 shown in FIG. 2 upon transition from 2-cycle mode under self ignition control to 4-cycle mode under self ignition control.

In the transient cycle T3, the timing for closing the exhaust valve 134 is set to BTDC 55°. That is, the set timing is earlier than the timing in 4-cycle mode under self ignition control after the mode transition by the value corresponding to 10° as the rotating angle of the crankshaft 148 (see FIG. 5). This may make the quantity of the combusted fuel gas that resides in the combustion chamber 150 larger than that in 4-cycle mode under self ignition control. This makes it possible to make the temperature of the air fuel mixture within the combustion chamber higher.

In the engine operation in 2-cycle mode under self ignition control, the temperature of the combusted fuel gas is lower than that in the engine operation in 4-cycle mode under self ignition control. The quantity of the injected fuel in the 2-cycle mode is reduced to be in the range between 50% and 60% of the quantity of the injected fuel in the 4-cycle mode so as to make each engine torque substantially the same in the area close to the boundary at which the operation mode is switched. The temperature of the combusted fuel gas is low immediately after switching of the operation mode from 2-cycle mode under self ignition control to 4-cycle mode under self ignition control, resulting in misfire. In the transition cycle T3, the temperature of the air fuel mixture within the combustion chamber is made higher by performing the aforementioned operation. This makes it possible to prevent the misfire even in the engine operation in the 4-cycle mode under self ignition control after switching of the operation mode.

In the transition cycle T3, the timing for closing the intake valve 132 is set to ABDC 30°. That is, such timing is made earlier than the timing in 4-cycle mode under self ignition control after the mode transition by the value corresponding to 10° as the rotating angle of the crankshaft (see FIG. 5). In the transition cycle T3, therefore, the actual compression ratio becomes higher than that of 4-cycle mode under self ignition control. This makes it possible to prevent the misfire in 4-cycle mode under self ignition control after the mode transition.

In the transition cycle T3, the spark plug 136 is operated for spark ignition at a timing BTDC 20°, preventing the misfire.

In the transition cycle T3, the timing for opening the intake valve 132 is set to ATDC 55°. That is, such timing is delayed from the timing in 4-cycle mode under self ignition control after the mode transition by the value corresponding to 10° as the rotating angle of the crank shaft 148.

In the engine operation within the period at which both the exhaust valve 134 and the intake valve 132 are closed (between BTDC 45° and ATDC 45° as shown in FIG. 5), that is, for the negative overlap period, when the timing for closing the exhaust valve 134 is made earlier, the amount of work of the piston 144 with respect to the combusted fuel gas within the combustion chamber 150 is increased. In the second embodiment, the timing for closing the exhaust valve 134 is made earlier and the timing for opening the intake valve 132 is delayed. This makes it possible to collect the work of the piston 144 with respect to the combusted fuel gas in the form of the downward movement of the piston 144 after passing TDC, that is, the rotating motion of the crankshaft 148. As a result, the operation efficiency of the engine can be enhanced. Especially in the second embodiment, the exhaust valve 134 is closed at BTDC 55°, and the intake valve 132 is opened at ATDC 55°. Substantially the whole work of the piston 144 with respect to the combusted fuel gas can be collected as the rotating motion of the crankshaft 148.

B-2. Transition from 4-Cycle Mode under Self Ignition Control to 2-Cycle Mode Self Ignition Control The timing for operating the intake valve 132 and the exhaust valve 134 in the transition cycle T4 (see FIG. 2) upon transition from 4-cycle mode under self ignition control to 2-cycle mode under self ignition control is the same as that in the transition T1. The respective operations shown in FIG. 7 are the same as those in the transition T1. Each operation shown in FIG. 7 that is performed once in the order from opening of the exhaust valve 134 is the same as that shown in the transition cycle T1.

In the transition cycle T4, the timing for opening the exhaust valve 134 is set to BBDC 40° in the same manner as in the 4-cycle mode under self ignition control before the mode transition as shown in FIG. 7 (see FIG. 5). Accordingly no torque change occurs upon performing the transition cycle T4 after completion of the operation in 4-cycle mode under self ignition control.

The quantity of the injected fuel in the transition cycle T4 is a predetermined value in the range between 50% and 60% of the quantity of the injected fuel in the operation in 4-cycle mode under self ignition control before the mode transition. This makes it possible to smoothly switch the operation mode in accordance with the arrow T4 shown in FIG. 2 upon transition from 4-cycle mode under self ignition control to 2-cycle mode under self ignition control.

In the transition cycle T4, the timing for opening the intake valve 132 is set to BBDC 30°. That is, the period taken from opening of the exhaust valve 134 to opening of the intake valve 132 is shorter than the period in the operation in 2-cycle mode under self ignition control after the mode transition by the value corresponding to 10° as the rotating angle of the crankshaft 148 (see FIG. 6). The quantity of the combusted fuel gas returned into the intake passage 12 from the intake port 12*o* in the transition cycle T4 is larger than that in the operation in 2-cycle mode under self ignition control. As a result, the quantity of the combusted fuel gas that resides in the combustion chamber 150 is increased in the state where the intake valve 132 is closed is increased. The quantity of air admitted into the combustion chamber 150 during the intake stroke becomes smaller than that in the operation in 2-cycle mode under self ignition control after the mode transition. This makes it possible to prevent the misfire owing to excessive air.

In the transition cycle T4, the spark plug 136 is operated at a timing BTDC 20°, thus preventing misfire.

In the transition cycle T4, the timing for closing the exhaust valve 134 and the intake valve 132 is set to ABDC 65°. That is, the timing is delayed from that in the 2-cycle mode under self ignition control after the mode transition by values each corresponding to 25° and 15°, respectively as the rotating angle of the crankshaft 148 (see FIG. 6). The actual compression ratio in the transition cycle T4 is lower than that in the 2-cycle mode under self ignition control after the mode transition. This may lower the possibility of the self ignition before the piston 144 moves up to reach the position to the sufficiently high level even if the temperature of the combusted fuel gas obtained after the operation in 4-cycle mode under self ignition control is relatively high. The increase in NOx contained in the exhaust gas or noise caused by the self ignition at an earlier stage may be restrained. The transition cycle T4 is effective for restraining the self ignition at the earlier stage as its scavenging period is longer than that in the operation mode after the mode transition.

C. Third Embodiment

In a third embodiment, switching of the operation mode between 4-cycle mode under spark ignition control in the high load and 4-cycle mode under self ignition control will be described. The transition from the 4-cycle mode under spark ignition control in the high load to the 4-cycle mode under self ignition control is represented by arrow T5. The transition from the 4-cycle mode under self ignition control to the 4-cycle mode under spark ignition control in the high load is represented by arrow T6 . The structure of the engine 10 and each operation of the respective modes are the same as those described in the first embodiment.

Figure 10:
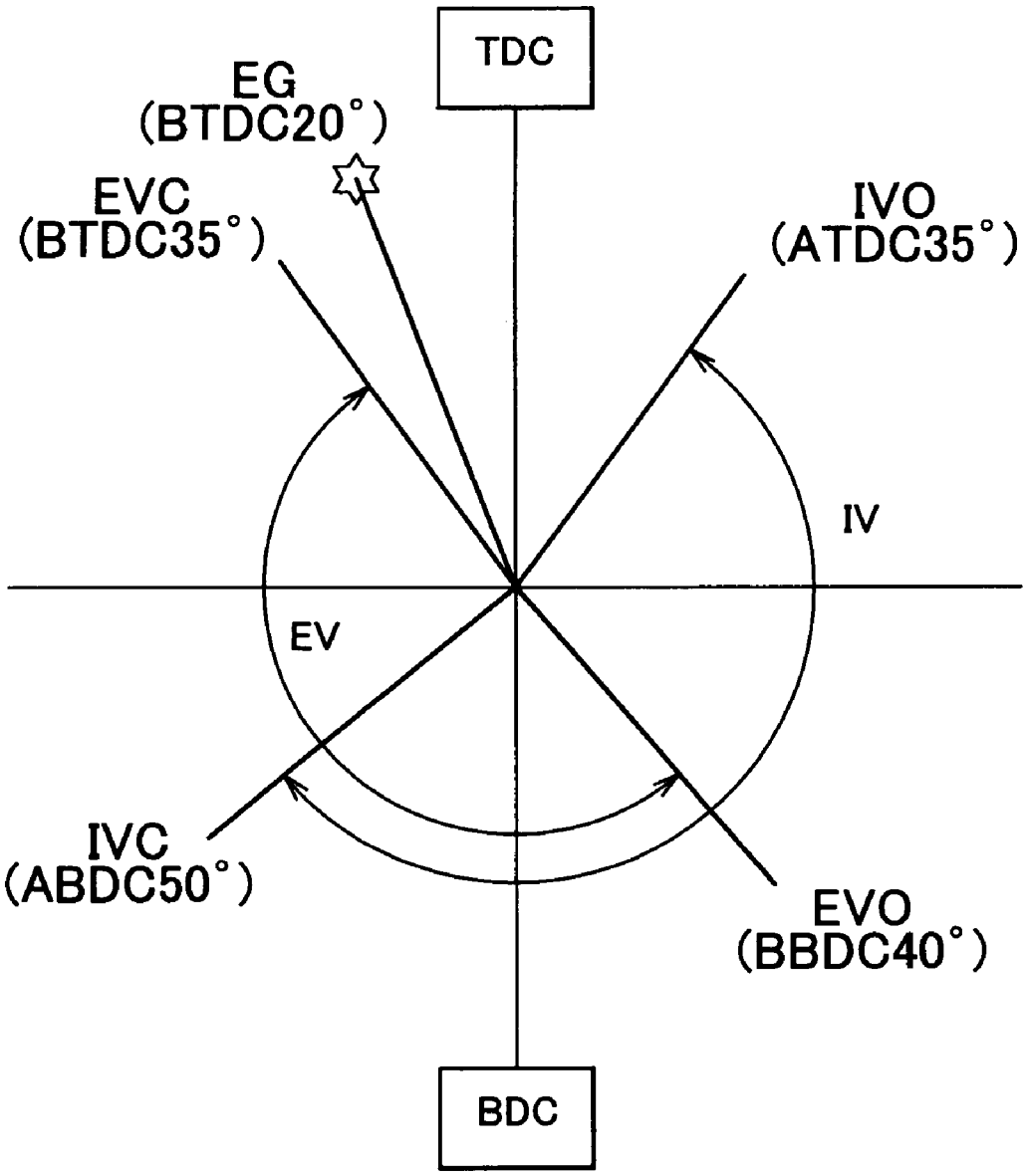
FIG. 10 is an explanatory view that shows a timing for operating the intake and exhaust valves in the transition cycle upon selection from the 4-cycle spark ignition mode in high load to the 4-cycle self ignition mode in the medium load at high engine speed.

C-1. Transition from 4-Cycle Mode under Spark Ignition Control to 4-Cycle Mode under Self Ignition Control FIG. 10 is a view that represents the timing for operating the intake valve 132 and the exhaust valve 134 in a transition cycle T5 performed upon transition of the operation mode from 4-cycle mode under spark ignition control in the high load to 4-cycle mode under self ignition control in the medium load. In the transition cycle T5 upon the transition to 4-cycle mode under self ignition control, the 4 cycle engine operation is performed. Like the transition cycle T2, the respective operations shown in the drawing are performed once in the order from opening of the exhaust valve 134.

The quantity of the injected fuel in the transition cycle T5 is decreased from that of the injected fuel in the 4-cycle mode under spark ignition control before the mode transition. This makes it possible to smoothly switch the operation mode in accordance with, for example, the arrow T5 shown in FIG. 2 upon transition from 4 cycle mode under spark ignition control to 4-cycle mode under self ignition control.

In the transition cycle T5, the timing for closing the exhaust valve 134 is set to BTDC 35°. That is, it is delayed from the timing in the 4-cycle mode under self ignition control after the mode transition by the value corresponding to 10° as the rotating angle of the crankshaft 148 (see FIG. 5). This may make the quantity of the combusted fuel gas that resides in the combustion chamber 150 smaller than that in the 4-cycle mode under self ignition control. Accordingly the self ignition at an earlier stage is unlikely to occur in the 4-cycle mode under self ignition control after the mode transition. This makes it possible to restrain the increase in NOx contained in the exhaust gas or noise caused by the self ignition at the earlier stage.

In the transition cycle T5, the timing for closing the intake valve 132 is set to ABDC 50°. That is, it is delayed from the timing in the 4-cycle mode under self ignition control after the mode transition by the value corresponding to 10° as the rotating angle of the crankshaft 148 (see FIG. 5). In the transition cycle T5, the actual compression ratio becomes lower than that in the 4-cycle mode under self ignition control. From the aforementioned aspect, the self ignition at the earlier stage is unlikely to occur in the 4-cycle mode under self ignition control after the mode transition.

In this embodiment, the transition cycle T5 is performed upon transition of the operation mode from 4-cycle mode under spark ignition control in the high load to 4-cycle mode under self ignition control in the medium load at high engine speed. However, the transition cycle T5L may be performed upon transition of the operation mode from 4-cycle mode under spark ignition control in the low load to 4-cycle mode under self ignition control in the medium load at high engine speed as well (see FIG. 2).

Figure 11:
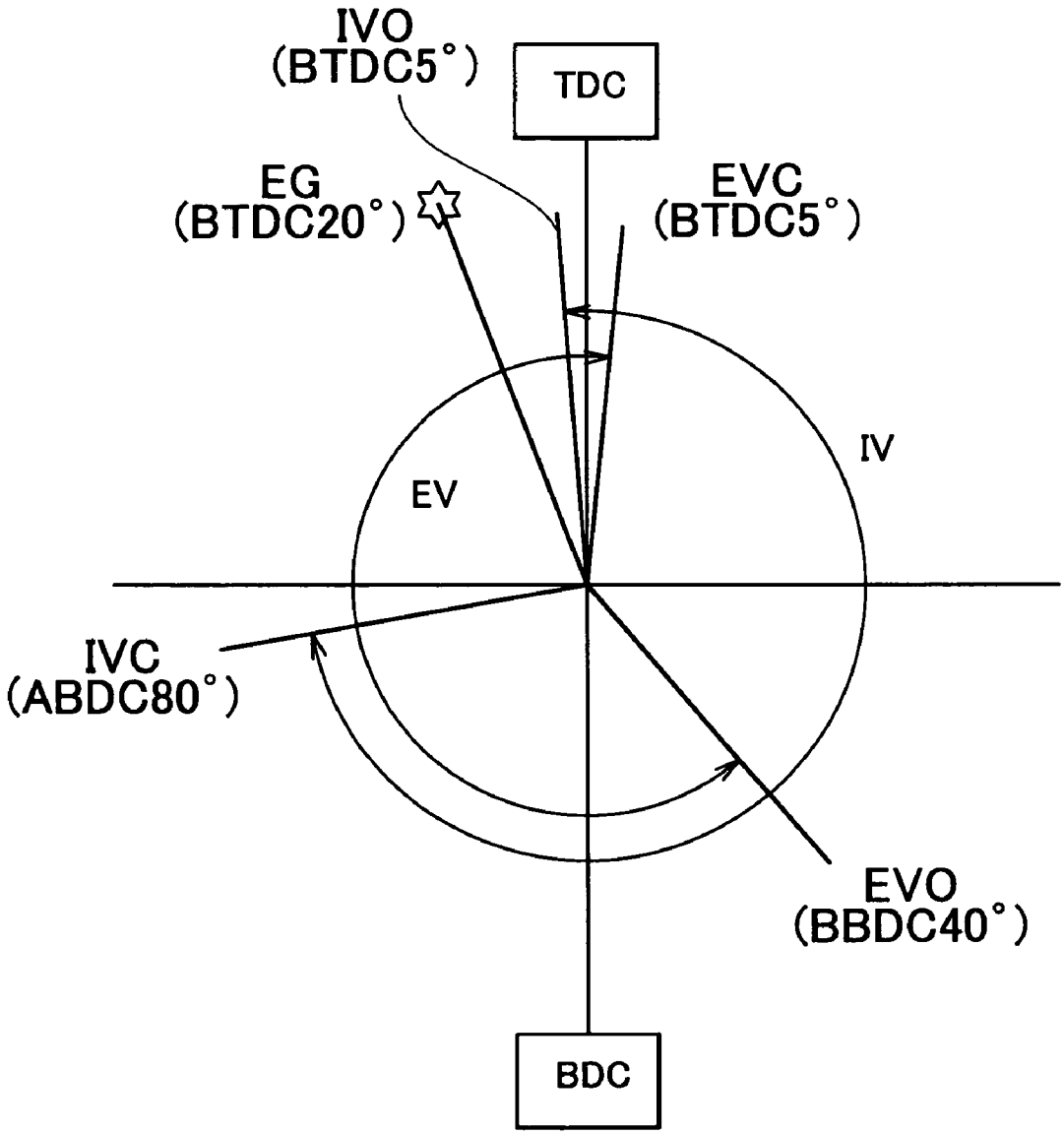
FIG. 11 is an explanatory view that shows a timing for operating the intake and exhaust valves in the transition cycle upon selection from the 4-cycle self ignition mode in the medium load at high engine speed to the 4-cycle spark ignition mode in the high load.

C-2. Transition from 4-Cycle Mode under Self Ignition Control to 4-Cycle Mode under Spark Ignition Control FIG. 11 is a view that represents the timing for operating the intake valve 132 and the exhaust valve 134 upon transition from 4-cycle mode under self ignition control in the medium load at high engine speed to 4-cycle mode under spark ignition control in the high load. In a transition cycle T6 upon transition to 4-cycle mode under spark ignition control, the 4-cycle engine operation is performed. Like the transition cycle T2, the respective operations shown in the drawing are performed once in the order from opening of the exhaust valve 134.

The quantity of the injected fuel in the transition cycle T6 is increased from that of the injected fuel in the 4-cycle mode under spark ignition mode before the mode transition. This makes it possible to smoothly switch the operation mode in accordance with, for example, the arrow T6 shown in FIG. 2 upon transition from the 4-cycle mode under self ignition control to 4-cycle mode under spark ignition control.

In the transition cycle T6, the timing for closing the intake valve 132 is set at ABDC 80°. That is, it is made earlier than the timing in the 4-cycle mode under spark ignition control after the mode transition by the value corresponding to 10° as the rotating angle of the crankshaft 148 (see FIG. 4). As a result, the actual compression ratio of the transition cycle T6 becomes higher than that in the 4-cycle mode under spark ignition control.

In the operation in 4-cycle mode under self ignition control, the temperature of the cylinder wall is kept low. The temperature of the air fuel mixture within the combustion chamber is lowered immediately after switching of the operation mode from 4-cycle mode under self ignition control to 4-cycle mode under spark ignition control. As a result, misfire is likely to occur. Further the combustion tends to become slow as it proceeds to the latter stage, which is likely to increase HC. In the transition cycle T6, however, the actual compression ratio is made higher by performing the aforementioned operation. This may prevent misfire and increase in HC.

In this embodiment, the transition cycle T6 is performed upon transition of the operation mode from 4-cycle mode under self ignition control in the medium load at high engine speed to 4-cycle mode under spark ignition control in the high load. However, the transition cycle T6L may be performed upon transition from 4-cycle mode under self ignition control in the medium load at high engine speed to 4-cycle mode under spark ignition control in the low load (see FIG. 2).

D. Fourth Embodiment

In a fourth embodiment, the procedure for switching the operation mode in the engine between 4-cycle mode under spark ignition control in the high load and 2-cycle mode under self ignition control will be described.

Figure 12:
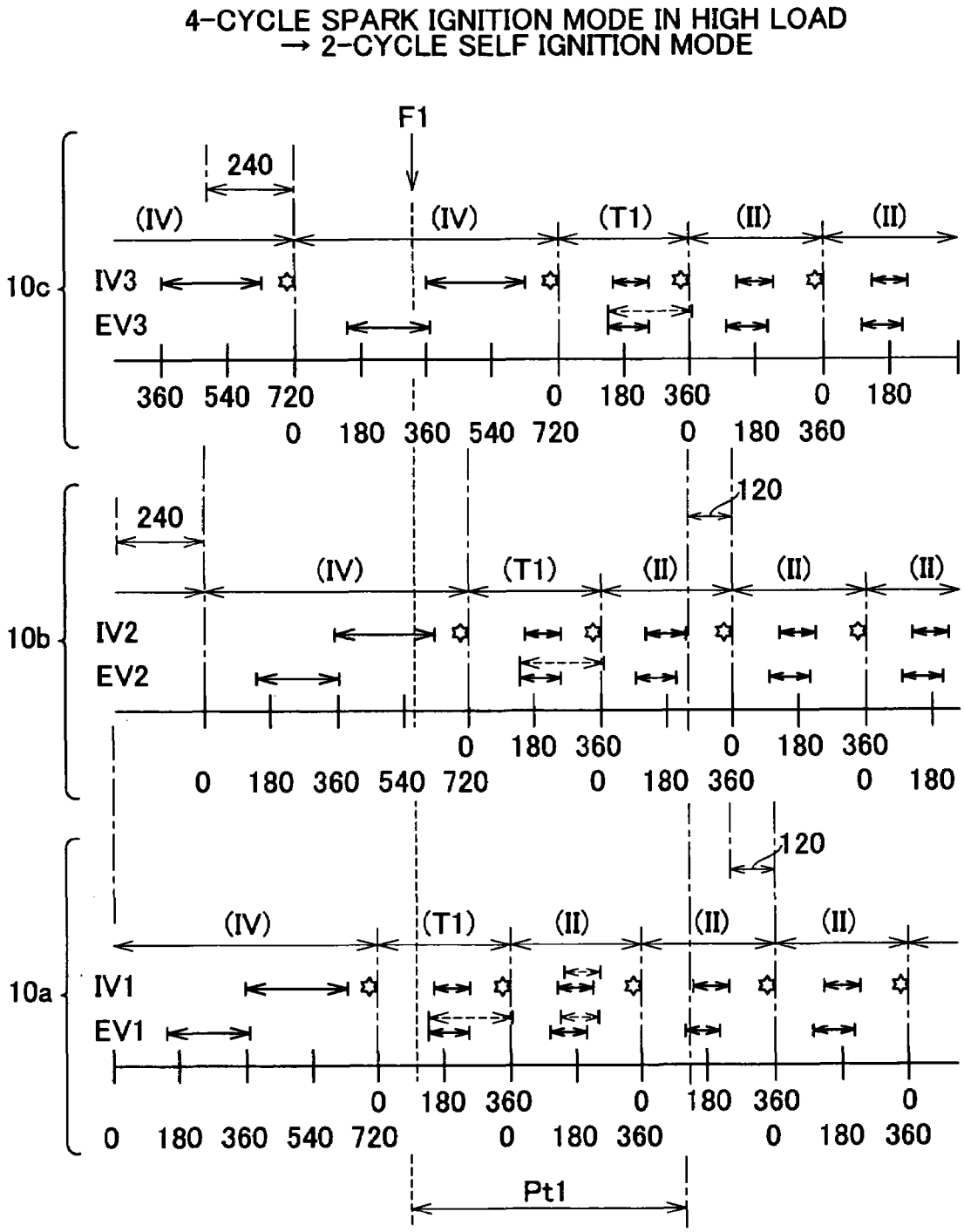
FIG. 12 is a timing chart that represents the transition state of a 3-cylinder engine from the 4-cycle spark ignition mode in high load to the 2-cycle self ignition mode.

D-1. Transition from 4-Cycle Mode under Spark Ignition Control to 2-Cycle Mode under Self Ignition Control FIG. 12 is a timing chart that represents the transition of the operation mode of the 3-cylinder engine 10 from 4-cycle mode under spark ignition control in the high load to 2-cycle mode under self ignition control. Referring to FIG. 12, three timing charts each corresponding to the respective combustion chamber units 10*a* to 10*c* are shown. The timing chart of the first combustion chamber unit 10*a* is shown in the third stage, the second combustion chamber unit 10*b* is shown in the second stage, and the third combustion chamber unit 10*c* is shown in the first stage, respectively. The timing represented by arrow F1 represents the time at which the request for transition from 4-cycle mode under spark ignition control to 2-cycle mode under self ignition control has been issued. The "time at which the request for the mode transition is issued" may be defined as the time at which the operation state of the engine exceeds the boundary of the respective operation mode areas on the map as shown in FIG. 2, which is caused by the change in the required load or the engine speed.

The horizontal line below each timing chart represents the rotating angle of the crankshaft 148 or crank angle. In the 4-cycle operation, a single cycle operation is performed while the crankshaft 148 is rotating twice. The portion of the horizontal line corresponding to the 4-cycle operation is designated with the angle ranging from 0 to 720°. While in the 2-cycle operation, a single cycle operation is performed while the crankshaft 148 is rotating once. The portion of the horizontal line corresponding to the 2-cycle operation is designated with the angle ranging from 0 to 360°. Each timing of 0, 360°, 720° designated on the horizontal line represents the timing TDC where the piston is at the top dead center. Each timing of 180° and 540° designated on the horizontal line represents the timing BDC where the piston is at the bottom dead center (see FIGS. 3 to 11).

The operation mode is shown on the upper portion of each of the timing charts. The reference (IV) represents 4-cycle mode under spark ignition control, and (II) represents 2-cycle mode under self ignition control. The numeral that represents the operation mode corresponds to the number of the area where each mode is performed as shown in FIG. 2. The reference (T1) represents the transition T1. In the intermediate portion of each of the timing charts, the line with arrowed ends designated as IV1 to IV3 represents the period for which the intake valve 132 is opened. The line with arrowed ends designated as EV1 to EV3 represents the period for which the exhaust valve 134 is opened. Each white star shown on each portion of the IV1 to IV3 represents the spark ignition timing.

Each of the combustion chamber units is operated in 4-cycle mode under spark ignition control before switching of the operation mode in the order from the first combustion chamber unit 10*a* as the lowest one, the second combustion chamber unit 10*b* as the intermediate one, and the third combustion chamber unit 10*c* as the uppermost one, each phase of which is shifted by 240°. In the 4 cycle operation, a single cycle is performed while the crankshaft 148 is rotating twice (at 720°). Therefore, in the 3-cylinder engine, each of the combustion chamber units is operated by shifting each phase at 240° as the value obtained by dividing 720° by the number of cylinders, that is, 3. This may allow the interval of the explosion in each combustion chamber unit to be uniform, thus realizing smooth operation.

Each of the combustion chamber units is operated in 2-cycle mode under spark ignition control before switching of the operation mode in the order from the first combustion chamber unit 10*a* in the lower one, the second combustion chamber unit 10*b* as the intermediate stage, and the third combustion chamber unit 10*c* in the upper stage, each phase of which is shifted by 120°. In the 2 mode cycle operation, a single cycle is performed while the crankshaft 148 is rotating once. Therefore, in the 3-cylinder engine, each of the combustion chamber units is operated by shifting each phase at 120° as the value obtained by dividing 360° by the number of cylinders, that is, 3. This may allow the interval of the explosion in each combustion chamber unit to be uniform, thus realizing smooth operation.

Referring to FIG. 12, a boundary shown by a chain line is provided at the crank angle of 0 and 720° in the operation in 4-cycle mode, and at the crank angle of 0 and 360° in the operation in 2-cycle mode, respectively. The references (IV), (II), and (T1) representative of the respective operation modes and the transition cycle are shown in the area defined by the chain line. Actually, however, the operation mode is not switched at the timing of the crank angle at 0, 360°, and 720°, but switched at the timing for opening the exhaust valve 134. That is, as aforementioned with respect to the description of each of the transition cycles, the exhaust valve 134 is opened at the timing in accordance with the subsequent operation mode or the transition cycle upon switching of the operation mode. Thereafter, the operation mode is switched by closing the exhaust valve 134, operating the intake valve 132, and injecting the fuel in accordance with the operation mode after transition or the transition cycle.

Figure 13:
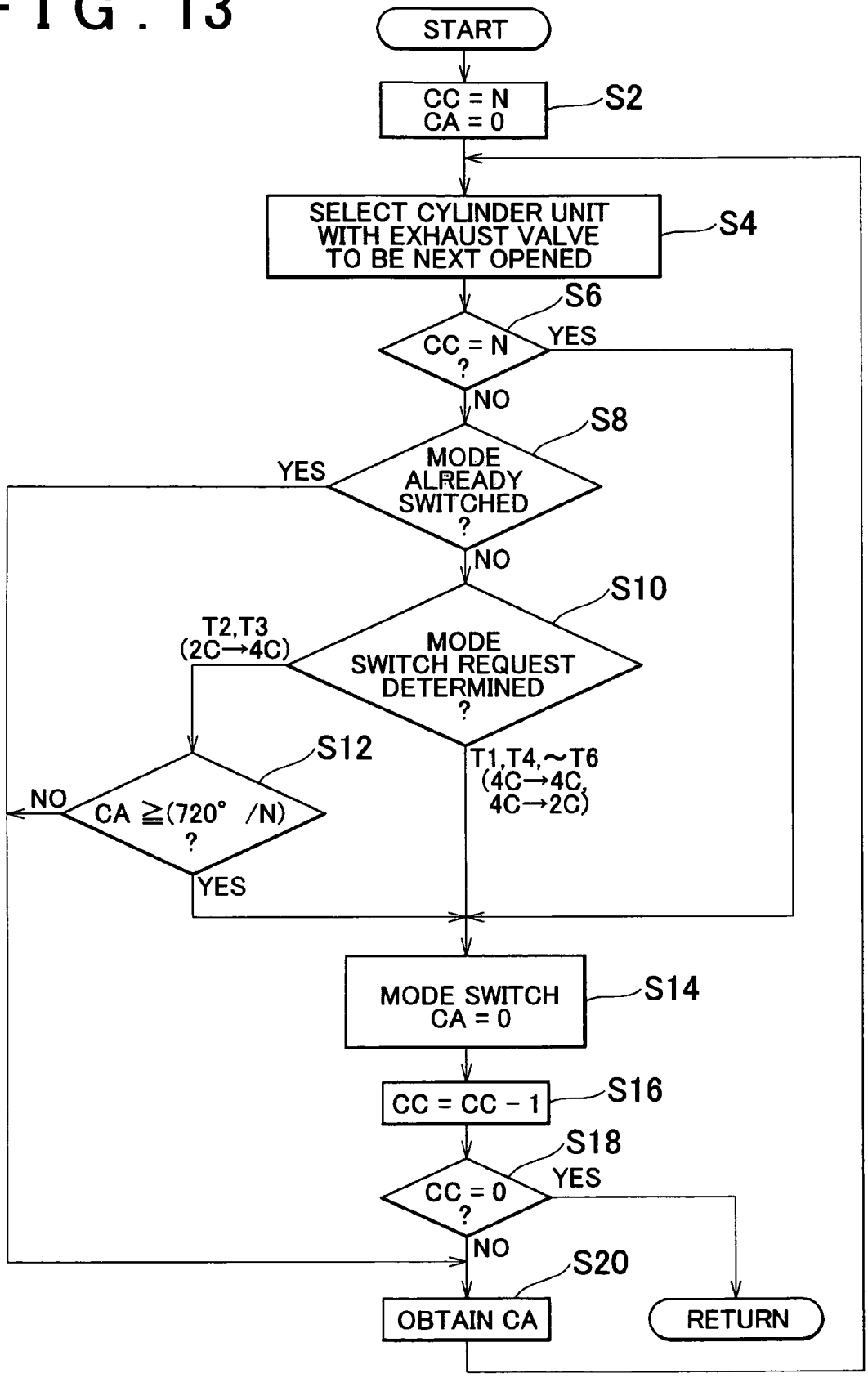
FIG. 13 is a flowchart that represents the procedure for selecting the operation mode of an engine having a plurality of cylinders.

FIG. 13 is a flowchart of the procedure for switching the operation mode in the engine with a plurality of cylinders. In response to the request for switching the operation mode, the ECU 30 sets a cylinder counter CC to N, and an angle counter CA to 0 in step S2. The cylinder counter CC indicates the number of cylinders each having the operation mode kept unchanged. The term N indicates the number of cylinders provided in the engine. In this embodiment, N is set to 3. The angle counter CA indicates a rotating angle of the crankshaft 148, which is counted from opening of the exhaust valve 134 in the cylinder where the transition cycle starts.

The process then proceeds to step S4 where the ECU 30 selects the combustion chamber unit assumed to have the exhaust valve 134 opened at the earliest timing on the assumption that the engine operation in 4-cycle mode under spark ignition control is subsequently performed in the respective combustion chamber units followed by the process in step S4. Referring to FIG. 12, there is a time section at which the exhaust valve is assumed to be opened at the earliest timing upon start of the process in response to the mode switching request F1 among the respective combustion chamber units in each section of EV1 to EV3. Each of the time sections is represented by the dashed line with arrowed ends. In FIG. 12, the first combustion chamber unit 10*a* in the lower stage is assumed to have the exhaust valve 134 opened at the earliest timing immediately after receipt of the mode switching request F1. Accordingly, in an example shown in FIG. 12, the combustion chamber unit 10*a* is selected in step S4.

In step S6, it is determined whether the cylinder counter CC is set to N, that is, whether the selected combustion chamber unit is the one having the mode transition first performed. When the cylinder counter CC is set to N, that is, Yes is obtained in step S6, the process proceeds to step S14 where the transition cycle is performed. In the combustion chamber unit, when the exhaust valve 134 is opened in the next cycle, the angle counter CA is reset to 0. In the example shown in FIG. 12, in step S14, the transition T1 is to be performed in the next cycle in the first combustion chamber unit 10*a*. Upon opening of the exhaust valve 134 in the transition T1 at the timing BBDC 40° in the combustion chamber unit 10*a*, the angle counter CA is set to 0 in step S14.

The process proceeds to step S16 where the cylinder counter CC is decremented by 1. In the example shown in FIG. 12, the cylinder counter CC is set to 2 by decrementing 1 from 3. The value of the cylinder counter CC, that is, 2, indicates two combustion chamber units 10*b* and 10*c* each having the mode kept unchanged.

In step S18, it is determined whether the cylinder counter CC is set to 0, that is, the mode transition has been completed with respect to all the combustion chamber units. When it is determined that the cylinder counter CC is set to 0, that is, Yes is obtained in step S18, the process for the mode transition is terminated. When it is determined that the cylinder counter CC is not set to 0, that is, No is obtained in step S18, the process proceeds to step S20. In the example shown in FIG. 12, as the cylinder counter CC is set to 2, No is obtained in step S18.

In step S20, the ECU 30 obtains the angle counter CA indicating the rotating angle of the crankshaft 148 from opening of the exhaust valve 134 in the combustion unit where the transition cycle is started, and the process returns to step S4. In the example shown in FIG. 12, the rotating angle of the crankshaft 148 from opening of the exhaust valve 134 in the combustion chamber unit 10*a* is set as the angle counter CA in step S20.

In step S4, the ECU 30 selects the combustion chamber unit having the exhaust valve 134 opened at the earliest timing after process in step S4 as aforementioned. In the example shown in FIG. 12, the time at which the process is executed in step S4 corresponds to the timing immediately after opening of the exhaust valve 134 in the combustion chamber unit 10*a* at the earliest timing. Therefore, the ECU 30 selects the next combustion chamber unit 10*b* having the exhaust valve 134 opened at the next earliest timing.

Then in step S6, it is determined whether the cylinder counter CC is set to N, that is, the selected combustion chamber unit is the first one that allows the transition cycle to be performed. In the example shown in FIG. 12, the cylinder counter CC is set to 2. As the counter number 2 is not equal to the number of the combustion chamber unit, that is, 3, No is obtained in step S6.

Then in step S8, it is determined whether the combustion chamber unit selected in step S4 is the one having the operation mode already switched. When it is determined that the selected combustion chamber unit has the operation mode already switched, that is, Yes is obtained in step S8, the process proceeds to step S20 where the angle counter CA is obtained. When it is determined that the selected combustion chamber unit does not have the operation mode switched, that is, No is obtained in step S8, the process proceeds to step S10. In the example shown in FIG. 12, as the combustion chamber unit 10*b* that has been selected in step S4 does not have the operation mode switched yet, No is obtained in step S8 and the process proceeds to step S10.

In step S10, the mode switching request is determined. The case in which the mode switching is required for transition from 2 cycle operation to 4 cycle operation will be described later. When the mode switching request is determined as the transition from 4 cycle operation to 2 cycle operation or from 4 cycle operation to 4 cycle operation, the process proceeds to step S14. If the mode switching request is determined as the transition cycles of T1, and T4 to T6, the process proceeds to step S14.

In step S14, execution of the transition cycle in the selected combustion chamber unit is required for the next cycle. The angle counter CA is set to 0 upon opening of the exhaust valve 134 in the designated combustion chamber unit. In the example shown in FIG. 12, in step S14, execution of the transition cycle T1 is required in the next cycle of the second combustion chamber unit 10*b*. The angle counter CA is set to 0 at the timing BBDC 40° at which the exhaust valve 134 is opened in the transition T1 in the combustion chamber unit 10*b*.

In step S16, the cylinder counter CC is decremented by 1. In the example shown in FIG. 12, the cylinder counter CC is set to 1 by decrementing 1 from 2. Then in step S118, it is determined whether the cylinder counter CC is set to 0. In the example shown in FIG. 12, the cylinder counter CC is set to 1. Accordingly in step S18, No is obtained. The process then proceeds to step S20 where the angle counter CA is obtained, and the process returns to step S4.

The operation mode is switched with respect to the third combustion chamber unit 10*c* in the upper stage shown in FIG. 12. Upon switching of the operation mode in the third combustion chamber unit 10*c*, the cylinder counter value becomes 0 in step S16. Accordingly Yes is obtained in step S18, and the operation mode transition process is terminated.

As shown in FIG. 12, the transition cycle is executed once with respect to each of the combustion chamber units. This makes it possible to rapidly switch the operation mode in the engine.

In the transition cycle upon switching of the operation to self ignition control, the ignition control that is different from the self ignition is performed. The ECU 30 executes not only the transition cycle but also the ignition control in the same manner as in the transition cycle for a predetermined period with respect to the respective combustion chamber units. In the example shown in FIG. 12, in 2-cycle mode under self ignition control after switching of the operation mode, the spark ignition is generally performed at a timing BTDC 10° (see FIG. 6). In the transition cycle T1, the spark ignition is performed at the timing BTDC 20° (see FIG. 4). Within a period Pt1 (shown in the lower stage of FIG. 12) taken from the mode switching request to completion of the transition T1 with respect to all the combustion chamber units, in the combustion chamber unit having the cycle at the timing TDC 360°, the spark ignition is performed at BTDC 20° in the same manner as the transition cycle T1.

The aforementioned control makes it possible to realize stable operation without misfire even after switching of the operation mode. In the case where the spark ignition is performed at BTDC 20°, the white star mark shown in FIG. 12 that indicates the ignition timing is in contact with the chain line representative of the crank angle 0. In the case where the spark ignition is performed at BTDC 10°, the white star mark is positioned over the chain line.

In the section of the combustion chamber unit 10*a* in the lower stage, the valve operation timing in the transition T1 during the first cycle of the operation in 2-cycle mode under self ignition control is represented by the chain line such that the valve operation timing in 2-cycle mode under self ignition control is compared with that in the transition cycle T1.

D-2. Transition from 2-Cycle Mode under Self-Ignition Control to 4-Cycle Mode under Spark Ignition Control The transition of the engine operation from 2-cycle mode under self ignition control to 4-cycle mode under spark ignition control will be described as well as each process executed in steps S10 and S12 in the flowchart of FIG. 13.

Figure 14:
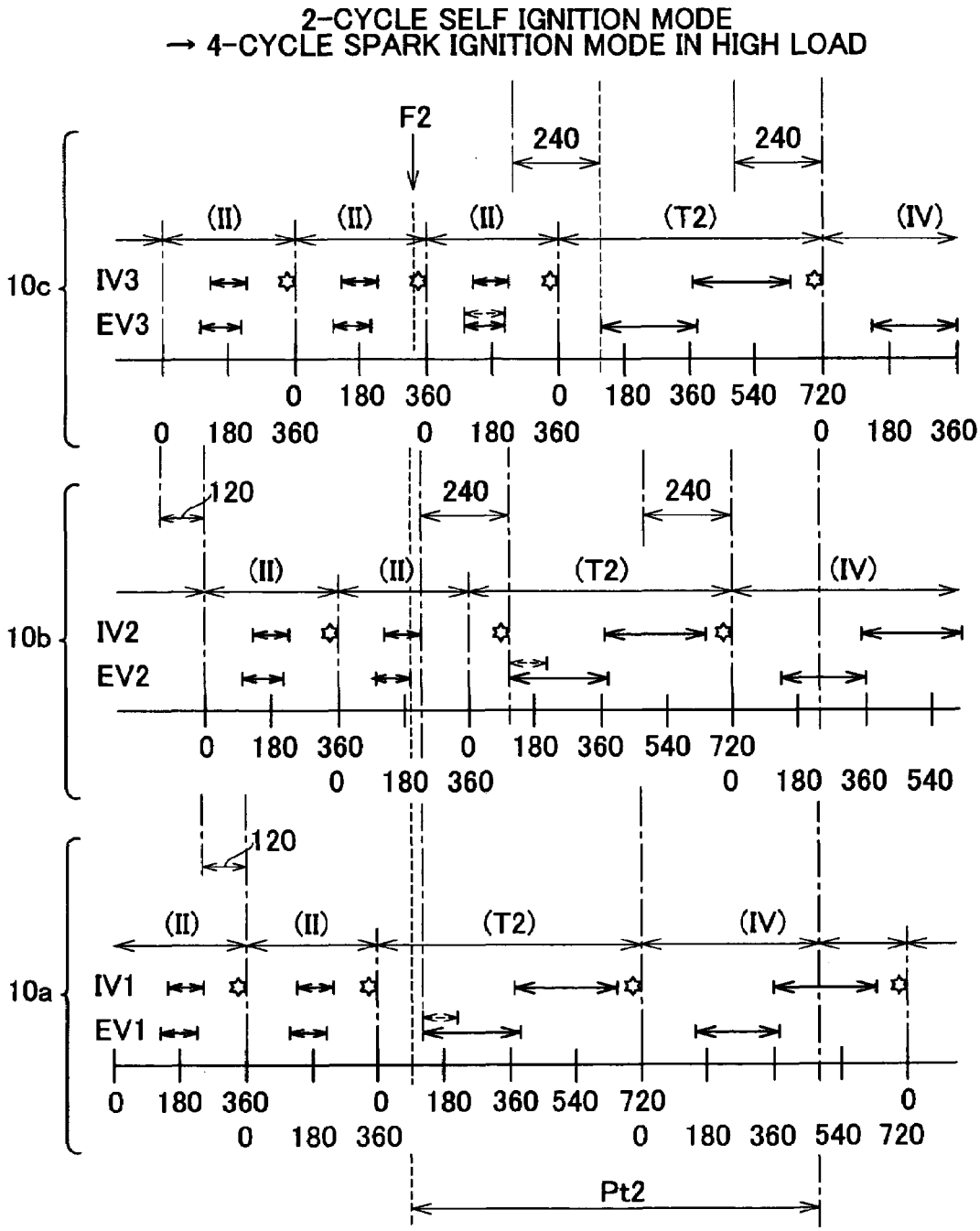
FIG. 14 is a timing chart that represents the transition state of the 3-cylinder engine from the 2-cycle self ignition mode to the 4-cycle spark ignition mode in the high load.

FIG. 14 is a timing chart that represents the transition of the operation of the 3-cylinder engine 10 from 2-cycle mode under self ignition control to 4-cycle mode under spark ignition control in the high load. The timing represented by arrow F2 shown in the upper portion of the drawing represents the time at which the operation mode transition request from the 2-cycle mode under self ignition control to 4-cycle mode under spark ignition control is received. Other descriptions in FIG. 14 are the same as those shown in FIG. 12.

The operation of each of the combustion chamber units in 2-cycle mode under self ignition control before switching of the operation mode is performed from the third combustion chamber unit 10*c* in the upper stage of FIG. 14, the second combustion chamber unit 10*b* in the intermediate stage, and the first combustion chamber unit 10*a* in the lower stage by shifting the phase by 120°, respectively. The operation of each of the combustion chamber units in 4-cycle mode under spark ignition control after switching of the operation mode is performed from the first combustion chamber unit 10*a* in the lower stage of FIG. 14, the second combustion chamber unit 10*b* in the intermediate stage, and the third combustion chamber unit 10*c* in the upper stage by shifting the phase by 240°, respectively. As the combustion chamber units are operated by shifting the phase at a uniform interval, the smooth operation can be realized in the respective operation modes.

In an example shown in FIG. 14, when the mode switching process is started upon the mode switching request F2, the third combustion chamber unit 10*c* in the lower stage of FIG. 14 has the exhaust valve 134 opened at the earliest timing. Accordingly, the mode switching process is started first in the third combustion chamber unit 10*c* in accordance with the flowchart in FIG. 13.

When the exhaust valve is opened in the transition T2 in the first combustion chamber unit 10*a* in the lower stage of FIG. 14, at the timing immediately after opening of the exhaust valve (the state immediately after completion of step S14 of the flowchart in FIG. 13), the third combustion chamber unit 10*c* in the upper stage of FIG. 14 is assumed to have the exhaust valve opened in the earliest timing. The combustion chamber unit 10*c*, thus, is selected in step S4.

As the transition T2 has been already performed in the first combustion chamber unit 10*a* as shown in the lower stage of FIG. 14, the cylinder counter CC is set to 2. Accordingly No is obtained in step S6 subsequent to step S4. As the operation mode switching has not been performed in the third combustion chamber unit 10*c* as shown in the upper stage of FIG. 14, No is obtained in step S8.

In step S10, the mode switching request is determined as aforementioned. As the transition from 4-cycle mode under spark ignition control to 2-cycle mode under self ignition control described herein corresponds to the transition from 2 cycle operation mode to 4 cycle operation mode, the process proceeds to step S12.

In step S12, it is determined whether the angle counter CA is set to the value substantially equal to or greater than 720°/N. The term N represents the number of the combustion chamber units of the engine, that is, 3 in this embodiment. The angle counter CA indicates the rotating angle of the crankshaft 148 obtained from opening of the exhaust valve 134 in the cylinder where the transition cycle is started.

The value of the angle counter CA, that is, "substantially equal to or greater than 720°/N", defined herein may be set in accordance with the range of the engine speed and the speed of the cycle in the flowchart shown in FIG. 13. For example, in step S12, it may be determined whether the value of the angle counter CA is equal to or greater than 715°/N. Alternatively it may be determined whether the value of the angle counter CA is equal to or greater than 719°/N so long as the cycle speed in the flowchart of FIG. 13 is sufficiently high with respect to the engine speed. In the case where the operation mode is switched in step S14 subsequent to step S12, the determination is made such that the interval between the opening timing of the exhaust valve 134 and the opening timing of the exhaust valve 134 in the combustion chamber unit having the transition cycle performed becomes 720°/N. In this embodiment, it is determined whether the angle counter CA is equal to or greater than 720°/N just for simplifying the explanation.

In step S12, in the cylinder where the transition cycle is started, when the crankshaft 148 has rotated at the angle lower than 240° after opening the exhaust valve 134, that is, No is obtained, the value of the angle counter CA is obtained in step S20. The process then returns to step S4. The process is executed in steps S4 to S10, S12 and S20 repeatedly until the rotating angle of the crankshaft 149 becomes 240° in the cylinder where the transition cycle is started and the exhaust valve 134 is opened.

In step S12, in the cylinder where the transition cycle is started, when the crankshaft 148 rotates at the angle of 240° from opening of the exhaust valve 134, that is, Yes is obtained, the process proceeds to step S14 where the mode switching is performed.

In an example shown in FIG. 14, immediately after opening of the exhaust valve in the transition T2 in the first combustion chamber unit 10*a* as shown in the lower stage of FIG. 14, the crankshaft 148 rotates at the rotating angle lower than 240°. Accordingly the determination in step S12 to be executed next becomes No, and the process proceeds to step S20 where the angle counter CA is obtained. The process then returns to step S4.

As the process is executed in steps S4 to S11, S12, and S20 repeatedly, the exhaust valve 134 is opened in 2-cycle mode under self ignition control before the mode transition in the third combustion chamber unit 10*c* as shown in the upper stage of FIG. 14. Even at the aforementioned timing, the crankshaft 148 rotates at the rotating angle lower than 240°. However, as the exhaust valve 134 is opened in the combustion chamber unit 10*c*, the combustion chamber unit to be selected in step S4 is changed from 10*c* to 10*b*.

As the process is executed in steps S4 to S10, S12, and S20 repeatedly, the exhaust valve 134 is opened in the combustion chamber unit 10*a* where the transition cycle is started. The crankshaft 148 then rotates at the rotating angle of 240°. Accordingly Yes is obtained in step S12, and the process proceeds to step S14 where the mode switching is performed in the combustion chamber unit 10*b*. As has been described, subsequent to the switching of the operation mode, each of the combustion chamber units is operated at the shifted phase of 720°/N, that is, 240°. This makes it possible to make the interval of the explosion stroke uniform in each of the combustion chamber units after switching of the operation mode, resulting in the operation with reduced torque change.

In the combustion chamber unit having the cycle at TDC 720° within the period Pt2 taken from the mode switching request to completion of the transition T2 with respect to all the combustion chamber units, the spark plug 136 is operated for spark ignition at the timing BTDC 20° as well as the transition cycle T2.

In this embodiment, the procedure for transition from the operation in 2-cycle mode under self ignition control in the medium load at low engine speed to the operation in 4-cycle mode under spark ignition control has been described. However, the transition with respect to other operation modes (see FIG. 2) may be performed in the same procedure.

E. MODIFIED EXAMPLE

It is to be understood that the invention is not limited to the aforementioned embodiments, and can be modified into various forms without departing from the scope of the invention as described below.

(1) In the aforementioned embodiments, the timing for operating the intake valve and the exhaust valve is represented by the crank angle of the crankshaft. However, it can be represented by other value that corresponds to, for example, configuration of the combustion chamber, characteristic of the combustion, excess air ratio and the like. According to the embodiments, in the operation under the spark ignition control and transition cycle, and in the cycle in the mode immediately after the mode switching (the cycle in the period Pt1 shown in FIG. 12, and the cycle in the period Pt2 shown in FIG. 14), the spark ignition is performed at BTDC 20°. The spark ignition in those cycles may be performed in the other timing. It is, however, preferable to set the timing between BTDC 15° and 30°.

The ignition timing in the operation in spark ignition control and transition cycle, and in the cycle in the operation mode immediately after switching of the mode may be different from one another. The ignition control at a predetermined timing before top dead center in the aforementioned cycle is referred to as the combustion ignition control herein.

Each of the timing for spark ignition in the respective cycles under the spark ignition control, and the timing for spark ignition in the transition cycle does not have to be constant. In other words, the ignition timing can be varied in accordance with the temperature of the cylinder wall or the combustion chamber, pressure in the combustion chamber, engine speed and the like.

In the operation in 4-cycle mode under self ignition control and 2-cycle mode under self ignition control, the ignition is performed at BTDC 10° as being delayed from the timing under the spark ignition control. The ignition, however, may be performed at the different timing so long as it is delayed from the timing under the spark ignition control.

In the embodiments, the valve opening timing in the transition cycle is different from that in the operation mode after the transition. In the transition cycle, the operation in the same cycle as that in the operation mode after the transition is performed. Therefore, it is possible to have at least one of the timing for operating one of the valves, the fuel injection quantity or the fuel injection timing in the transition cycle different from that in the operation in the mode after transition.

(2) In the embodiments, the transition cycle is performed only in a single cycle. However, it may be performed in two or more cycles.

(3) In the embodiments, the timing for closing the exhaust valve 134 in the operation mode that has been performed prior to the transition cycle coincides with the timing for closing the exhaust valve 134 in the transition cycle. However, those timings do not have to be coincided with each other so long as the timing for closing the exhaust valve in the transition cycle is set at a predetermined value corresponding to the timing close to the one in the operation mode that has been performed prior to the transition cycle. The predetermined value may be in the range including the crank angle of +/−5° from the timing in the mode prior to the transient cycle.

(4) In the embodiments, although four types of operation modes are performed, the type may be arbitrarily set to be three or less, or five or more. In the embodiments, the operation in 2-cycle mode under the combustion ignition control is not performed. It is, however, possible to perform the operation in such mode. Assuming that the area defined by the required load and the engine speed is divided into the first area in the relatively higher required load, the second area in the relatively lower required load, and the third area as being intermediate between the first and the second areas, it is preferable to perform the operation in those areas in the different operation modes, respectively. Preferably the combustion ignition control is executed both in the first and the second areas, and self ignition combustion control is executed in the third area.

(5) In the embodiments, the operation of 3-cylinder engine has been described. However, the number of the cylinders, that is, combustion chambers may be set to any value. It is, however, preferable to set the number of the combustion chambers to the value in multiples of 3. It is preferable to open the exhaust valve of each of the combustion chambers in the transition cycle at an interval of 720°/N upon switching of the operation mode from 2 cycle to 4 cycle. The operation mode can be switched to 4 cycle at the different timing so long as the engine has four or more combustion chambers. In the case where the engine has six combustion chambers, each exhaust valve of two combustion chambers is opened in the transition cycle at an interval of 240°. If the number of combustion chambers provided in the engine is in multiples of 3, it is preferable to perform transition of the mode to 4 cycle operation at an interval of {720°/(3×m) }. The term "m" indicates an integer that is larger than 0 and equal to or smaller than the value obtained by dividing the number of cylinders by 3.

(6) In the embodiments, the intake valve 132 and the exhaust valve 134 are driven by the electric actuators 162, 164, respectively. However, those valves can be driven by other devices with hydraulic pressure. The engine can be formed in various forms so long as it includes driving portions for driving the intake valve and the exhaust valve such that timing for operating those valves can be changed.

What is claimed is:

1. An engine with variable cycle switchable between a 4-cycle mode and a 2-cycle mode, the engine comprising:

a plurality of combustion chambers each including a cylinder, a piston, an intake valve and an exhaust valve provided in the cylinder, a fuel injection unit for injecting fuel into the cylinder, and an ignition unit for ignition of the fuel within the cylinder; and a controller that controls an operation of the intake valve, the exhaust valve, the fuel injection unit, and the ignition unit, the controller:

executing a plurality of operation modes in accordance with a combination of one of the 4-cycle mode and the 2-cycle mode with one of a combustion ignition control and a self ignition priority control, the combustion ignition control performing an ignition with the ignition unit at a predetermined timing before top dead center of the piston, and the self ignition priority control performing one of an ignition without the ignition unit and an ignition with the ignition unit at a timing delayed from the predetermined timing under the combustion ignition control; and performing at least one transition cycle upon switching of an operation mode of the engine between a first operation mode and a second operation mode, the first operation mode being performed before the switching, the second operation mode being performed after the switching, and the transition cycle performing an operation of a same cycle type as the second operation mode under the combustion ignition control, wherein:

the transition cycle is different from the second operation mode in at least one of an intake valve opening timing, an intake valve closing timing, an exhaust valve opening timing, an exhaust valve closing timing, an injection quantity of the fuel, and an injection timing of the fuel; and the combustion ignition control is executed in one of the combustion chambers where a single cycle of the transition cycle is terminated until each of all the combustion chambers terminates a single cycle of the transition cycle irrespective of the second operation mode under one of the combustion ignition control and self ignition priority control.

2. The engine according to claim 1, wherein:

the first operation mode comprises the 2-cycle mode;

the second operation mode comprises the 4-cycle mode under the combustion ignition control;

each of the transition cycle and the second operation mode has an overlap period at which both the intake valve and the exhaust valve are opened; and the intake valve opening timing in the transition cycle is delayed from the intake valve opening timing in the second operation mode.

3. The engine according to claim 1, wherein:

the exhaust valve opening timing in the transition cycle is set to a predetermined timing that is close to the exhaust valve opening timing in the first operation mode; and the fuel is injected in the first operation mode upon a transition from the first operation mode to the transition cycle, and the exhaust valve is opened in the transition cycle after combustion of the fuel.

4. The engine according to claim 1, wherein:

the first operation mode comprises the 2-cycle mode;

the second operation mode comprises the 4-cycle mode; and the controller opens the exhaust valve of one of the combustion chambers in the transition cycle subsequent to combustion of the fuel injected in the first operation mode upon transition from the first operation mode to the transition cycle, and opens the exhaust valve of the other combustion chamber in the transition cycle at a timing 720°/N delayed from the timing at which the exhaust valve is opened in the transition cycle in the one of the combustion chambers where the transition cycle is started.

5. The engine according to claim 1, wherein:

the first operation mode comprises the 2-cycle mode under the self ignition priority control;

the second operation mode comprises the 4-cycle mode under the self ignition priority control; and an actual compression ratio in the transition cycle is higher than the actual compression ratio in the second operation mode.

6. The engine according to claim 5, wherein the intake valve closing timing in the transition cycle is earlier than the valve closing timing in the second operation mode.

7. The engine according to claim 1, wherein:

the first operation mode comprises 2-cycle mode under the self ignition priority control;

the second operation mode comprises the 4-cycle mode under the self ignition priority control; and the exhaust valve closing timing in the transition cycle is earlier than the exhaust valve closing timing in the second operation mode.

8. The engine according to claim 7, wherein:

each of the transition cycle and the second operation mode has a period at which the intake valve and the exhaust valve are kept closed from closing of the exhaust valve to opening of the intake valve; and the intake valve opening timing in the transition cycle is delayed from the intake valve opening timing in the second operation mode.

9. The engine according to claim 1, wherein:

the first operation mode comprises the 4-cycle mode;

the second operation mode comprises the 2-cycle mode; and the injection quantity of the fuel in the transition cycle is in a range between ½ and ⅔ of the injection quantity of the fuel injected by the fuel injection unit in the first operation mode, and the period from opening of the exhaust valve to opening of the intake valve in the transition cycle is shorter than the period in the second operation mode.

10. The engine according to claim 1, wherein:

the first operation mode comprises the 4-cycle mode under the self ignition priority control;

the second operation mode comprises the 2-cycle mode under the self ignition priority control; and a period taken from opening of the intake valve to closing of the exhaust valve in the transition cycle is longer than the period in the second operation mode.

11. The engine according to claim 1, wherein:

the first operation mode comprises the 4-cycle mode under the self ignition priority control;

the second operation mode comprises the 2-cycle mode; and an actual compression ratio in the transition cycle is lower than the actual compression ratio in the second operation mode.

12. The engine according to claim 1, wherein:

the first operation mode comprises the 4-cycle mode under the combustion ignition control;

the second operation mode comprises the 4-cycle mode under the self ignition priority control; and the exhaust valve closing timing in the transition cycle is delayed from the exhaust valve closing timing in the second operation mode.

13. The engine according to claim 1, wherein:

the first operation mode comprises the 4-cycle mode under the combustion ignition control;

the second operation mode comprises the 4-cycle mode under the self ignition priority control; and an actual compression ratio in the transition cycle is lower than the actual compression ratio in the second operation mode.

14. The engine according to claim 1, wherein:

the first operation mode comprises the 4-cycle mode under the self ignition priority control;

the second operation mode comprises the 4-cycle mode under the combustion ignition control; and an actual compression ratio in the transition cycle is higher than the actual compression ratio in the second operation mode.

15. A method of switching an operation mode of an engine with a plurality of combustion chambers and a variable cycle switchable between a 4-cycle mode and a 2-cycle mode among a plurality of operation modes, the plurality of operation modes including a combination of one of the 4-cycle mode and the 2-cycle mode with one of a combustion ignition control and a self ignition priority control, the combustion ignition control performing an ignition with an ignition unit at a predetermined timing before top dead center of a piston of the engine, and the self ignition priority control performing one of an ignition without the ignition unit and an ignition with the ignition unit at a timing delayed from the predetermined timing under the combustion ignition control, in each of the plurality of combustion chambers, the method comprising the steps of:

(a) executing a first operation mode before switching of the operation mode;

(b) executing a second operation mode after switching of the operation mode; and (c) executing at least one transition cycle between the first operation mode and the second operation mode, the transition cycle having a same cycle type as the second operation mode, wherein:

the transition cycle is different from the second operation mode in one of an intake valve opening timing, an intake valve closing timing, an exhaust valve opening timing, and an exhaust valve closing timing, a fuel injection quantity, and a fuel injection timing; and the step (b) includes an execution of the combustion ignition control in one of the combustion chambers having a single operation of the transition cycle completed until the single operation of the transition cycle is terminated in each of all the combustion chambers in the step (c) irrespective of the second operation mode under one of the combustion ignition control and the self ignition priority control.

* * * * *